US012338598B2

(12) United States Patent
Kaufman et al.

(10) Patent No.: US 12,338,598 B2
(45) Date of Patent: Jun. 24, 2025

(54) MODULAR HELICAL PIER FOUNDATION SUPPORT SYSTEMS, ASSEMBLIES AND METHODS WITH SNAP-LOCK COUPLINGS

(71) Applicant: PIER TECH SYSTEMS LLC, Chesterfield, MO (US)

(72) Inventors: Kevin Kaufman, Des Peres, MO (US); Michael D. Wilkis, Ellisville, MO (US)

(73) Assignee: Pier Tech Systems, LLC, Chesterfield, MO (US)

( * ) Notice: Subject to any disclaimer, the term of this patent is extended or adjusted under 35 U.S.C. 154(b) by 686 days.

(21) Appl. No.: 17/174,805

(22) Filed: Feb. 12, 2021

(65) Prior Publication Data

US 2021/0254298 A1 Aug. 19, 2021

Related U.S. Application Data

(60) Provisional application No. 62/976,442, filed on Feb. 14, 2020.

(51) Int. Cl.

| | |
|---|---|
| ***E02D 5/52*** | (2006.01) |
| ***E02D 5/56*** | (2006.01) |
| ***E02D 27/48*** | (2006.01) |

(52) U.S. Cl.

CPC ..... *E02D 5/526* (2013.01); *E02D 2600/20* (2013.01)

(58) Field of Classification Search

CPC ..... E02D 5/526; E02D 2600/20; F16L 15/08; F16L 21/08; F16L 37/088; F16L 37/0885; F16L 37/252

See application file for complete search history.

(56) References Cited

U.S. PATENT DOCUMENTS

| | | | | | |
|---|---|---|---|---|---|
| 1,080,674 | A * | 12/1913 | Berg | F16L 37/252 285/239 |
| 1,080,675 | A * | 12/1913 | Berg | F16L 37/252 285/377 |
| 3,813,115 | A * | 5/1974 | French | F16L 37/252 285/391 |
| 9,453,318 | B2 * | 9/2016 | Kemp | E02D 5/56 |
| 9,458,593 | B2 | 10/2016 | Hale | |
| 9,863,114 | B2 | 1/2018 | Kaufman et al. | |
| 2004/0076479 | A1 | 4/2004 | Camilleri | |
| 2019/0249387 | A1 | 8/2019 | Horie et al. | |

FOREIGN PATENT DOCUMENTS

| | | | | |
|---|---|---|---|---|
| AU | 2013204548 | B2 | 5/2013 | |
| DE | 10055348 | A1 * | 5/2002 | B21D 22/22 |
| EP | 2505896 | A2 * | 10/2012 | F16L 33/03 |
| JP | 2001311143 | A | 11/2001 | |
| JP | 2018066152 | A | 4/2018 | |
| KR | 2020102637 | A * | 9/2020 | |

OTHER PUBLICATIONS

PCT International Search Report and Written Opinion issued for application No. PCT/US2021/017862, dated May 31, 2021 (9 pages).

* cited by examiner

*Primary Examiner* — Amber R Anderson
*Assistant Examiner* — Stacy N Lawson
(74) *Attorney, Agent, or Firm* — Armstrong Teasdale LLP

(57) ABSTRACT

Improved couplers for a building foundation support system include helical ribs and helical grooves in combination with an integrated spring retainer element that automatically snaps into place as the couplers are engaged. Rotational and axial interlocking attachment of support piles is therefore possible without utilizing separately provided fasteners such as bolts.

27 Claims, 19 Drawing Sheets

STATE OF THE ART

MODULAR HELICAL PIER FOUNDATION SUPPORT SYSTEMS, ASSEMBLIES AND METHODS WITH SNAP-LOCK COUPLINGS

CROSS-REFERENCE TO RELATED APPLICATIONS

This application claims the benefit of U.S. Provisional Application Ser. No. 62/976,442 filed Feb. 14, 2020, the entire disclosure of which is hereby incorporated by reference in its entirety.

BACKGROUND OF THE INVENTION

The present invention relates generally to building foundation support systems including assemblies of structural support shaft components, and more specifically to couplers for foundation support shaft components such as helical piers with integrated snap-lock coupler elements.

If a building foundation moves or settles in the course of construction, or at any time after construction is completed, such movement or settlement may affect the integrity of the building structure and lead to costly repairs. While much care is taken to construct stable foundations in new building projects, certain soil types or other building site conditions, or certain types of buildings or structures, may present particular concerns that call for additional measures to ensure the stability of building foundations.

Helical piers, also known as anchors, piles or screwpiles, are deep foundation solutions commonly used when standard foundation solutions are problematic. Helical piers are driven into the ground with reduced installation time and little soil disturbance compared to large excavation work that may otherwise be required by standard foundation techniques, and a number of helical piers may be installed at designated locations to transfer and distribute the weight of the building structure to load bearing soil to prevent the foundation from moving or shifting. Lifting elements, support brackets or load-bearing caps may be used in combination with the helical piers to construct various types of foundation support systems meeting different needs for both foundation repair and new construction applications.

When properly designed and when properly installed, existing foundation support systems are effective. Existing foundation support systems, however, tend to be rather difficult to install and are disadvantaged in ways that have yet to completely meet the needs of the marketplace. Improvements are therefore desired.

BRIEF DESCRIPTION OF THE DRAWINGS

Non-limiting and non-exhaustive embodiments are described with reference to the following Figures, wherein like reference numerals refer to like parts throughout the various drawings unless otherwise specified.

DETAILED DESCRIPTION OF THE INVENTION

In order to understand the inventive concepts described herein to their fullest extent, some discussion of the state of the art and certain problems and disadvantages that exist is set forth below, followed by exemplary embodiments of improved foundation support systems and components therefore which overcome such problems and disadvantages in the art.

Figure 1:
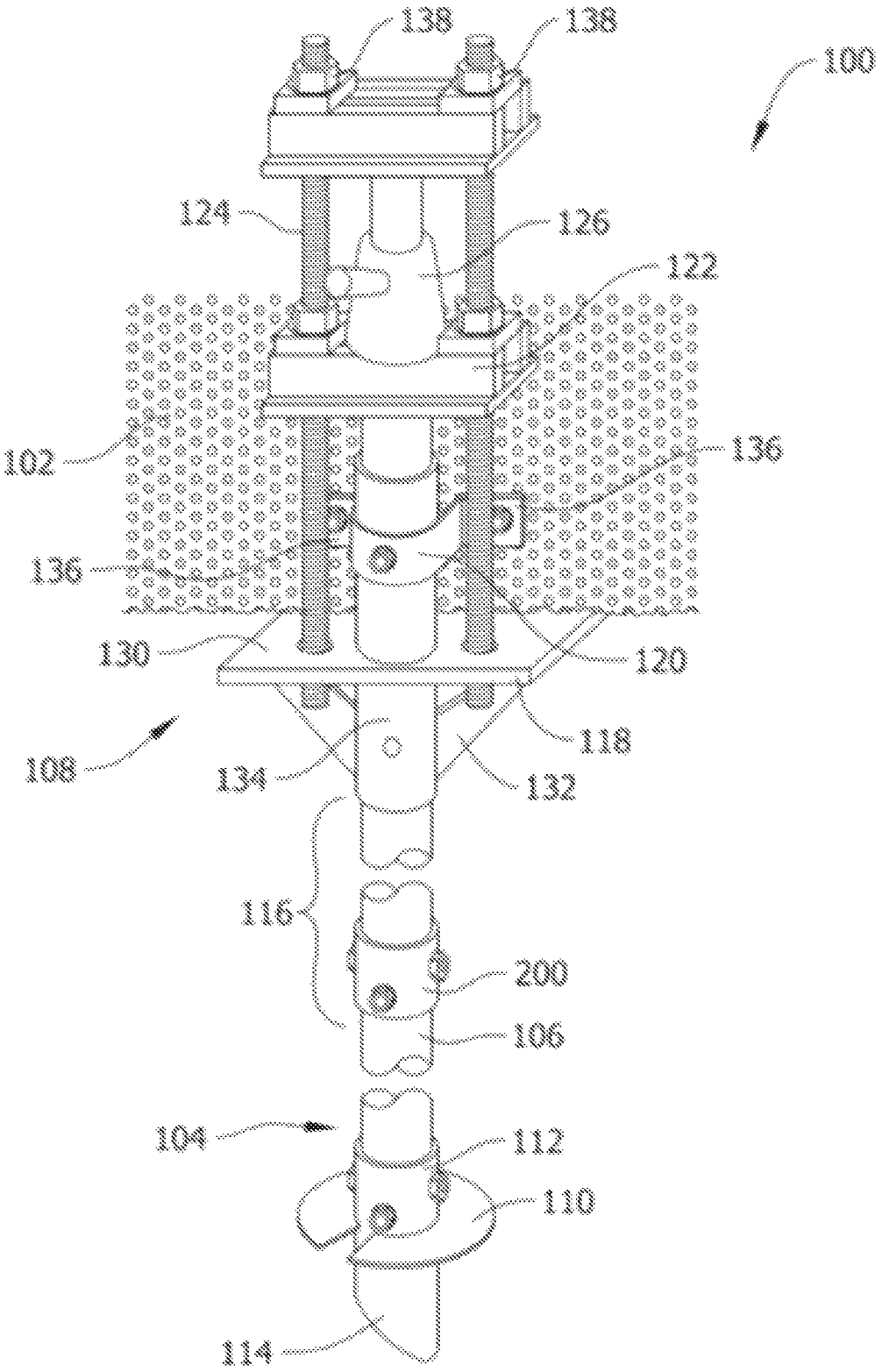
FIG. 1 illustrates a perspective view of a conventional foundation support system interacting with a building structure.
Figure 4:
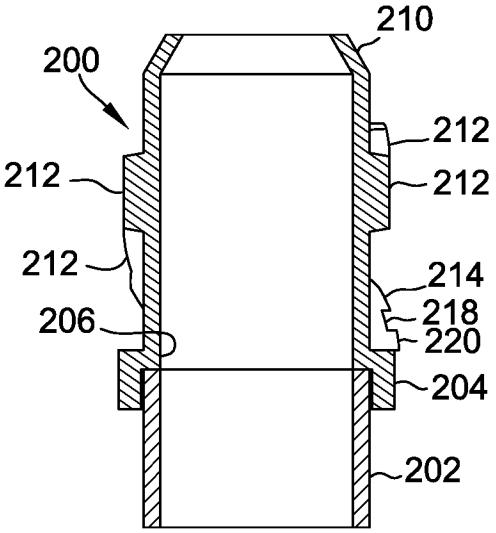
FIG. 4 is a cross-sectional view of the first coupler and support shaft shown in FIG. 3.

FIG. 1 illustrates a perspective view of a conventional foundation support system 100 in combination with a building foundation 102 which in turn supports a structure in residential, commercial or industrial construction. The structure being supported by the building foundation 102 may include various types of buildings, homes, edifices, etc. in real estate developments and improvements. The foundation support system 100 may be applied in the new construction of the building foundation 102 prior to the structure being completed, or may alternatively be applied for maintenance and repair purposes in a retrofit manner to a pre-existing building foundation at any desired time after the foundation 102 and building structure are initially constructed. While exemplary structures are mentioned above, the foundation support system 100 may be used in a similar manner to provide foundation support for various different types of structures and to securely support anticipated structural loads without more extensive excavation that standard building foundations otherwise require to provide a similar degree of support.

Primary piles or pipe shafts (hereinafter collectively referred to as a "pile" or "piles") 104 of appropriate size and dimension may be selected and may be driven into the ground or earth at a location proximate or near the foundation 102 using known methods and techniques. The size of the primary pile 104 and the insertion depth needed to provide the desired support may be determined according to known engineering methodology and analysis of the construction site and the particular structure that is to be supported. The primary piles 104 typically consist of a long shaft 106 that is driven into the ground to the desired depth, and a support element such as a plate or bracket (not shown) or a lifting element such as a lifting assembly 108 may be assembled to the shaft 106 proximate the foundation 102. The shaft 106 of the primary pile 104 may also include one or more lateral projections such as a helical auger 110. Such helical steel piles 104 are available from, for example, Pier Tech Systems (www.piertech.com) of Chesterfield, Missouri.

The helical auger 110 may in some embodiments be separately provided from the piling 104 and attached to the piling 104 by welding to a sleeve 112 including the auger 110 provided as a modular element fitting. As such, the sleeve 112 of the modular fitting may be slidably inserted over an end of the shaft 106 of the piling shaft 104 and secured into place with fasteners such as bolts as shown in FIG. 1. In such an embodiment, the sleeve 112 includes one or more pairs of fastener holes or openings for attachment to the piling shaft 106 with the fasteners shown. In the embodiment illustrated there are two pairs of fastener holes formed in the sleeve 112, which are aligned with corresponding fastener holes in the shaft 106 to accept orthogonally-oriented fasteners and establish a cross-bolt connection between the shaft 106 and the sleeve 112. To make a primary pile 104 with a particular length one merely slides the sleeve 112 onto a piling shaft 106 of the desired length and affixes the sleeve 112 in place. In the illustrated embodiment, the end of the piling shaft 106 is provided with a beveled tip 114 to better penetrate the ground during installation of the pile 104. In different embodiments, the tapered tip 114 may be provided on the shaft 106 of the piling 104, or alternatively, the tip 114 may be a feature of the modular fitting including the sleeve 112 and the auger 110.

The lifting assembly 108 may be attached to an upper end of the primary pile 104 after being driven into the ground. If the primary pile 104 is not sufficiently long enough to be driven far enough into the ground to provide the necessary support to the foundation 102, one or more extension piles 116 can be added to the primary pile 104 to extend its length in the assembly. The lifting assembly 108 may then be attached to one of the extension piles 116.

As shown in FIG. 1, the lifting assembly 108 interacts with the foundation 102 to support and lift the building foundation 102. In a contemplated embodiment, the lifting assembly 108 may include a bracket body 118, one or more bracket clamps 120 and accompanying fasteners, a slider block 122, and one or more supporting bolts 124 (comprising allthread rods, for example) and accompanying hardware. In another suitable embodiment the lifting assembly 108 may also include a jack 126 and a jacking block 128. Suitable lifting assemblies may correspond to those available from Pier Tech Systems (www.piertech.com) of Chesterfield, Missouri, including for example only the TRU-LIFT® bracket of Pier Tech Systems, although other lifting assemblies, lift brackets, and lift components from other providers may likewise be utilized in other embodiments.

The bracket body 118 in the example shown includes a generally flat lift plate 130, one or more optional gussets 132, and a generally cylindrical housing 134. The lift plate 130 is inserted under and interacts with the foundation or other structure 102 that is to be lifted or supported. The lift plate 130 includes an opening, with which the cylindrical housing 134 is aligned to accommodate one of the primary pile 104 or an extension pile 116. The housing 134 is generally perpendicular to the surface of lift plate 130 and extends above and below the plane of lift plate 130.

In the example shown, one or more gussets 132 are attached to the bottom surface of the lift plate 130 as well as to the lower portion of the housing 134 to increase the holding strength of the lift plate 130. In one embodiment, the gussets 132 are attached to the housing 134 by welding, although other secure means of attachment are encompassed within this invention.

In the example shown, the bracket clamps 120 include a generally Ω-shaped piece having a center hole at the apex of the "Ω" to accommodate a fastener. The Ω-shaped bracket clamp 120 includes ends 136, extending laterally, that include openings to accommodate fasteners. The fasteners extending through the openings in the ends 136 are attached to the foundation 102, while the fastener extending through the center opening at the apex of the "Ω" extends into an opening in the housing 134. In one embodiment the fastener extending through the center opening in the bracket clamp 120 and into the housing 134 further extends through one of the primary pile 104 or the extension pile 116 and into an opening on the opposite side of the housing 134, and then anchors into the foundation 102. In such cases, however, the fastener is not inserted through one of the primary pile 104 or the extension pile 116 until jacking or lifting has been completed, since bracket body 118 must be able to move relative to pile 104 or 116 in order to effect lifting of the foundation 102.

In one embodiment, the bracket body 118 is raised by tightening a pair of nuts 138 attached to the top ends of the supporting bolts 124. The nuts 138 may be tightened simultaneously, or alternatively, in succession in small increments with each step, so that the tension on the bolts 124 is kept roughly equal throughout the lifting process. In another suitable embodiment, the jack 126 is used to lift the bracket body 118. In this embodiment, longer support bolts 124 are provided and are configured to extend high enough above the slider block 122 to accommodate the jack 126 resting on the slider block 122, the jacking block 128, and the nuts 138.

When all of the components are in place as shown and sufficiently tightened, the jack 126 (of any type, although a hydraulic jack is preferred) is activated so as to lift the jacking plate 128. As the jacking plate 128 is lifted, force is transferred from the jacking plate 128 to the support bolts 124 and in turn to the lift plate 130 of the bracket body 118. When the foundation 102 has been lifted to the desired elevation, the nuts immediately above the slider block 122 (which are raised along with support bolts 124 during jacking) are tightened down, with approximately equal tension placed on each nut. At this point, the jack 126 can then be lowered while the bracket body 118 will be held at the correct elevation by the tightened nuts on the slider block 122. The jacking block 128 can then be removed and reused. The extra support bolt material above the nuts at the slider block 122 can be removed as well, using conventional cutting techniques.

The lifting assembly 108 and related methodology is not required in all implementations of the foundation support system 100. In certain installations, the foundation 102 is desirably supported and held in place but not moved or lifted, and in such installations the lifting assembly shown and described may be replaced by a support plate, support bracket or other element known in the art to hold the foundation 102 in place without lifting it first. Support plates, support brackets, support caps, and or other support components to hold a foundation in place are available from Pier Tech Systems (www.piertech.com) of Chesterfield, Missouri and other providers, any of which may be utilized in other embodiments of the foundation support system.

As mentioned, it is sometimes necessary to extend the length of a piling by connecting one or more shafts which in combination may provide support that extends deeper into the ground than the shafts individually can otherwise reach. For example, a first helical pier component, referred to as a primary pile, may be driven nearly fully into the ground at the desired location, and a connection component such as an extension pile may then be attached to the end of the primary pile in order to drive the primary pile deeper into the ground while supporting the building foundation at an end of the extension pile. More than one extension pile may be required depending on the lengths of the piles available and/or particular soil conditions.

However, attaching an extension pile to a primary pile to increase the length of the completed piling needed for the job can, be challenging. In conventional foundation support systems, including but not limited to the example shown in FIG. 1, the connection between the primary pile and extension pile is typically made via one or more bolts inserted through fastener holes in the ends of the primary pile and the extension pile. Conventionally, such fastener holes in some cases may be drilled on site as needed, or may be pre-formed in respective couplers that are attached to the primary pile and the extension pile. In either case, because the extension piece may be many feet long and is rather heavy, completing the desired connection to the primary pile with bolts presents a number of complications to an efficient and proper installation of the foundation support system.

As an initial matter, the primary pile and the extension pile must be properly aligned with one another so that the bolts can be inserted, and the bolts must then be tightened while the proper alignment is maintained. If the fastener holes to make the connections are not properly formed or are not properly aligned, difficulties in inserting the bolts are realized, especially so when the fastener holes are threaded and require precise and nearly exact alignment in order to install the bolts. Some trial and error positioning and repositioning of the extension pile is therefore typically required to align the primary pile and the extension pile so that the bolts can be installed, increasing the time and labor costs required to install a piling including the primary pile and the extension pile. When more than one extension pile is needed, such difficulties may be repetitively incurred with each extension pile and will cumulatively increase the time and labor costs required to install the foundation support system. Indeed, in some cases, installers may spend more time installing the bolts than driving the piles into the ground. Also, the difficulty incurred in aligning an extension pile to make the bolted connection to the primary pile can result in a bolted connection being completed, but in a suboptimal manner that can be compromise the integrity of the support system to provide the proper level of support and undesirably affect the support system capacity and reliability.

For example, the fastener holes may elongate or otherwise deform, or the bolts can be damaged, via any attempt to force-fit the bolts when difficulties are encountered or when subsequent torque is applied to drive the piling further into the ground. Any such damage or deformation of fastener holes can reduce the structural strength or capacity of the foundation support system. Likewise, the bolts may not be properly loaded if they are not installed as intended (e.g., if the bolts are installed at unintended angles), which can cause overstress and deformation of the fastener holes when subjected to torsional forces to drive the extension pile and primary pile into the ground.

Any deformation of the fastener holes, or misalignment of the bolts, may further cause a possibility of the joined ends of the primary pile and the extension pile to move relative to one another. Such relative movement is sometimes referred to herein as "play", and is inherently undesirable and detrimental to the intended support for the foundation that the pilling is supposed to present. Any play in the components during assembly may also introduce additional alignment difficulties and complications in completing a proper installation of the foundation system altogether, and may undesirably increase time and labor costs to complete the installation of the foundation support system.

More recent foundation support systems and components therefor have been developed to reduce the difficulties of interconnecting the foundation support components in the installation of a foundation support system, including but not necessarily limited to a primary pile and an extension pile. For example, patented, self-aligning coupler assemblies are available from Pier Tech Systems (www.piertech.com) of Chesterfield, Missouri that have greatly reduced the difficulties in establishing bolted connections in an installation of a foundation support system. See, e.g., U.S. Pat. Nos. 9,506,214; 9,863,114; and 10,294,623. The patented Pier Tech couplers include elongated axially extending ribs and elongated axially extending grooves that are mated to one another to establish torque transmitting connections therebetween, with self-alignment of the fastener holes as the couplers are mated to more easily complete the desired bolted connections. The bolts are also mechanically isolated in the patented Pier Tech couplers from torque transmission forces both for ease of installation and to prevent deformation of the fastener holes. Simpler, easier and more reliable installation of foundation support systems is therefore possible with the patented Pier Tech couplers, but further room for improvement exists.

For example, the bolts utilized to complete the foundation support connections with the desired strength are relatively large and expensive items which not only add to the cost of providing and installing foundation support systems, but introduce opportunity for installation error and complications apart from the alignment issues discussed above. For instance, if the bolts are improperly tightened (e.g., too loose or too tight) unintended results and effects may be realized that would desirably be avoided. Likewise, if the bolts are damaged or stripped either prior to or in the course of installation of a foundation support system, undesirable time and labor will be incurred to attend to such issues.

Finally, the bolts may be dropped, temporarily mislaid, or even lost in transit to a job site or in the course of any given installation of a foundation support system. Any damaged, dropped, mislaid or lost bolts introduces undesirable delays and increased labor costs to find them, repair them or locate replacement bolts, which may or may not readily be available on the job site. Even when no bolts are damaged, mislaid or lost, and when the alignment issues are resolved to complete the necessary connections of primary piles and extension piles, the time required to completely install all of the bolts required to complete the installation of any given foundation support system can still be undesirably high and therefore costly from a labor perspective. Especially when considered over the course of a number of pilings needed on the same or different job sites, accrued installation time to complete bolted connections can be substantial and significantly add to the costs of installing foundation support systems.

The patented Pier Tech couplers discussed above do not necessarily require bolted connections to complete an installation of a foundation support system and therefore present a partial solution to the problems above. When mated, the patented Pier Tech couplers are interlocked in the circumferential direction and are therefore fully cable of transmitting torque between them to drive the primary and extension piles into the ground, whether or not they are bolted together. The patented Pier Tech couplers, however, will not be positively interlocked or fastened to one another in the axial direction in the absence of separately provided bolts. As such, when the bolts are not utilized the couplers may be subject to an inadvertent separation when subjected to uplift forces that would tend to pull the couplers apart, potentially compromising the entire foundation support system.

Axially directed uplift forces on the pilings may be caused by wind and other conditions that are somewhat unpredictable and therefore can arise unexpectedly. Any separation of the couplers due to uplift forces that occur below ground would be very difficult to detect or correct. Therefore, while simply not utilizing the bolts would simplify the assembly and installation of a foundation support system including the patented Pier Tech couplers, this is not an entirely satisfactory solution.

Foundation support systems are also known including coupler features that are designed to be freely attachable and detachable to one another without utilizing separately provided fasteners such as bolts. For example, U.S. Patent Application Publication No. 2004/0076479 teaches a coupler arrangement including a socket and a spigot having respective axially and circumferentially oriented recesses and axially and circumferentially oriented protuberances that engage with another via an initial axial mating of the socket and spigot, followed by a rotation to interlockingly transmit forward and reverse drive of torque in respectively different orientations of the recesses and protuberances. When rotated circumferentially to an intermediate position between the rotationally interlocked positions, however, the couplers are freely detachable in the axial direction. Since there is no positive locking to prevent relative rotation of the couplers, however, the couplers may be inadvertently rotated to the intermediate position and possibly detached in the course of installation, or subject to separation due to uplift forces at a location below ground that would be very difficult to detect or correct. Therefore, while such couplers avoid bolted connections, they are not an entirely satisfactory solution.

For the reasons above, existing foundation support systems continue to be disadvantaged, and the needs of the marketplace have yet to be fully met. Foundation support systems that may be more quickly and easily installed with improved reliability are therefore desired to meet longstanding and unfulfilled needs in the art, especially from the perspective of the couplings needed to interconnect the support piles.

Exemplary embodiments of inventive coupler components and component assemblies to attach structural shaft elements such as a primary pile and an extension pile to one another in the installation of a foundation support system are described hereinbelow that address and overcome the deficiencies of existing foundation support systems in the aspects described above. Inventive methods of assembling, connecting installing and supporting building foundation elements are also described hereinbelow that address the problems and disadvantages in the art as discussed above.

More specifically, an interlocking self-aligning and torque transmitting coupler assembly of the present invention facilitates a simplified alignment and interlocking connection between, for example, a primary pile and an extension pile during assembly and installation of a building foundation support system. The interconnection is realized via first and second couplers that are designed for snap-lock engagement to one another which avoids any need for separately provided fasteners such as bolts, and therefore avoids the difficulties that such separately provided fasteners present, while importantly providing a positive interlock not only in the rotational direction to transmit torque as pilings are driven into the ground, but also in the axial direction to avoid any tendency of the couplers to separate when uplift forces exist.

In a contemplated embodiment the axial interlocking is realized via a retaining spring element that is integrated or built-in to the design of one of the first and second couplers instead of being separately provided and assembled to the coupler for installation. The retaining spring element automatically snaps into place and interlocks the couplers in the axial direction when the couplers are sufficiently engaged to a predetermined amount or degree. When desired, a tool may be used to dislodge the retaining spring element and separate the couplers as desired or as needed. Beneficially, the retaining spring element is intended to be permanently attached to one of the couplers and its automatic engagement to the second coupler as the couplers are mated to one another requires no separate action by the installer to establish the desired axial interlock in the connection established through the couplers. Specifically, and unlike separately provided fasteners in conventional foundation support systems, the built-in spring retainer element is less susceptible to being mislaid, lost, or damaged before, during or after any effort to install the foundation support system.

Also, in one example each of the first and second couplers features a plurality of helically extending ribs or grooves on the respective inner and outer surfaces thereof, which when engaged to one another provide a rotationally interlocked, torque transmitting connection as the pilings are driven into the ground, but the helical ribs and grooves also provide some degree of axial interlocking to more evenly distribute uplift forces in the mating surface of the couplers. As such, axially directed uplift forces are not borne solely on the retaining spring element, and a comparatively smaller and lower cost retaining spring element may be utilized that is easier to snap or un-snap with a reduced amount of force than would otherwise be required to engage or disengage a larger, stronger and more expensive retaining spring element. The helically extending ribs or grooves may be formed and shaped with ramp features that gradually cause an annular retaining spring element to expand or enlarge its diameter as the ribs and grooves are received and mated with one another. Circumferential retaining spaces such as grooves are also formed in each of the couplers, defining a space for the retaining spring element to reside and snap-lock into place and achieve the desired axial interlocking.

The helically extending ribs and grooves, coupled with tapered ends on the inner and outer surface realize a mostly self-guided engagement of ribs and grooves provided on the couplers, avoiding any need by an installer to precisely align the couplers to complete the connections. By partially mating the couplers and rotating one of the couplers about an axis of the coupler (corresponding to a longitudinal axis of a pile attached to the coupler), the helically ribs and grooves will engage via gravitational force with both vertical and rotational displacement. A pitch of the helically extending ribs or grooves is large such the couplers may be fully engaged, for example, with only about ¼ turn about the axis of the coupler, allowing quick and easy snap-lock connection that requires no bolts to complete.

By avoiding bolts and the issues presented by bolts, adequate lifting strength and support is reliably established with a much simpler installation that may be completed in significantly less time than a typical installation of an existing foundation support system requiring bolted connections that are considerably more difficult to complete to attach support piles to one another. By virtue of the inventive couplers of the present invention, improved foundation support elements may therefore be assembled more quickly and more reliably than before, while beneficially reducing labor costs and simultaneously improving system reliability. Method aspects of the inventive concepts will be in part apparent and in part explicitly discussed in the following description.

Referring now to FIGS. 2-18, exemplary embodiments of snap-lock couplers for foundation support shafts such as primary piles and extension piles according to the present invention include a first or male coupler 200 attachable to a first pile 202 (FIGS. 2-7) and a second or female coupler 250 attachable to a second pile 252 (FIGS. 8-13). The couplers 200, 250 may be utilized in lieu of the couplers designed for bolted connections in a foundation support system like the system 100 described above to provide the desired support to a building foundation, but with a much simpler, quicker and more reliable installation.

In contemplated embodiments, the first and second piles 202, 252 may be a primary pile and an extension pile, or alternatively may be two extension piles of the same or different length. The couplers 200, 250 may be separately manufactured from the piles 202, 252 in certain embodiments, and thereafter attached to each pile 250, 252 in a known manner, including but not necessarily limited to welding. Alternatively, the couplers 200, 250 may be integrally formed on respective ends of the piles 202, 252 via casting, forging and swaging processes instead of separately provided and attached elements. The couplers 200, 250 and the piles 202, 252 may each be fabricated from high strength steel or another suitable material according to known techniques.

As shown in FIGS. 2-6, the first coupler 200 is generally cylindrical and hollow, and is formed to include a generally round and larger diameter pile receiving end 204 that receives an end of the pile 202. In a contemplated embodiment, the pile 202 is an elongated, hollow, and round shaft having an outer diameter of 2.875 inches that fits snugly in the pile receiving end 204 up to a short distance before reaching a smaller diameter stop 206 formed in the coupler 200. Greater or lesser outer diameters of pile shafts may be accommodated in other embodiments, however. The coupler 200 also includes a relatively smaller diameter round main body 208 extending from the pile receiving end 204, and a tapered distal end 210 extending from the main body 208 opposite the pile receiving end 204.

Figure 3:
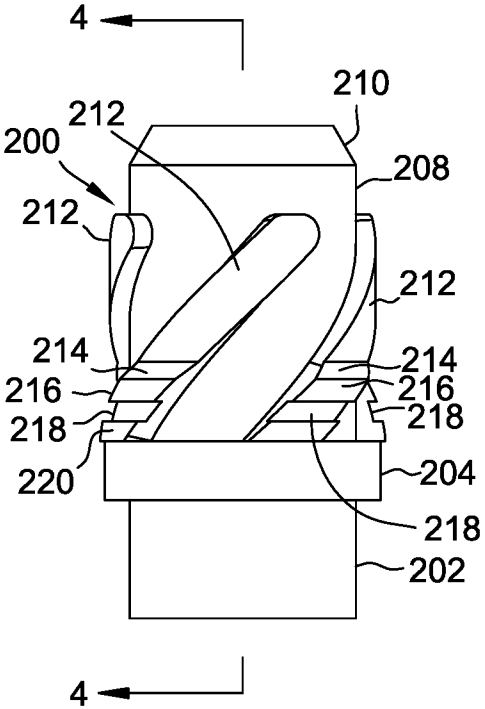
FIG. 3 is a side elevational view of the first coupler and support shaft shown in FIG. 2.
Figure 2:
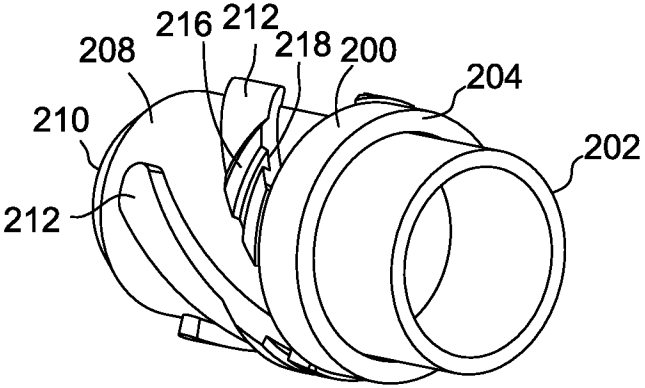
FIG. 2 is a perspective view of an exemplary embodiment of a first coupler and support shaft for a foundation support system according to the present invention.
Figure 7:
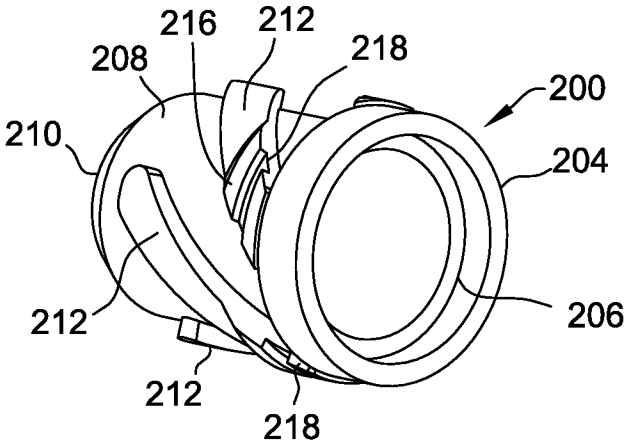
FIG. 7 is a perspective of the first coupler without the support shaft as shown in FIG. 2.
Figure 5:
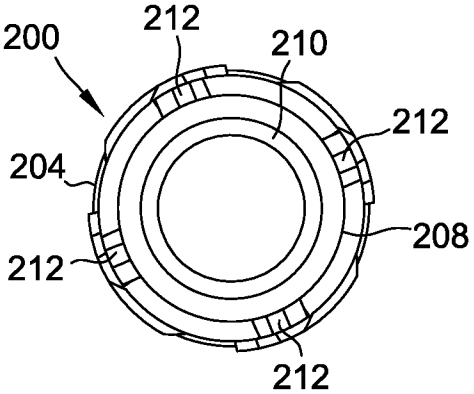
FIG. 5 is a first end view of the first coupler and support shaft shown in FIG. 3.
Figure 6:
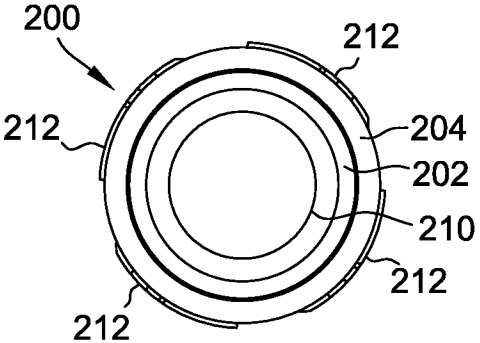
FIG. 6 is a second end view of the first coupler and support shaft shown in FIG. 3.

The main body 208 is formed with a number of outwardly projecting spaced apart and helically extending ribs 212 as best shown in FIGS. 2, 3, 5 and 7. In the example shown, four helical ribs 212 are provided that are spaced about 90° apart from one another on the round main body 208. The helical ribs 212 extend upon the outer surface of the main body with a relatively large pitch (i.e., the end-to-end vertical rise of the helical ribs in FIG. 3 is large compared to the angular path of the helical ribs in the radial or circumferential direction). In the illustrated example, the pitch of the helical ribs 212 is such that, from the base of the pile receiving end 204 to the distal end of each rib 212, about a quarter turn of a helix is completed. The helical ribs 212 extend as thread-like members on the outer surface of the main body 208, but are specifically distinguished from a more conventional threaded connection including small pitch helical threads that define multiple turns of a helix. While a specific geometry and a specific number of helical ribs 212 is shown and described, it is appreciated that alternative numbers and/or alternative geometries of ribs 212 is possible in another embodiment as demonstrated by the further examples of the couplers shown and described below in relation to FIGS. 19-23.

As best seen in FIG. 3, each helical rib 212 further includes a ramp 214 on exterior surface thereof. The ramp 214 has a variable but increasing outer diameter relative to a distal end portion of the rib 212 having a smaller but constant outer diameter. A shoulder 216 is located adjacent the ramp 214 in each rib 212, and a retaining groove 218 is located adjacent the shoulder in each of the ribs 212. A larger diameter retaining shoulder 220 extends on the other side of the retaining groove 218 in each rib 212 adjacent the pile receiving end 204. The diameter of the retaining shoulder is just a bit larger than the diameter of the pile receiving end 204 in the example shown, although variations are possible.

As shown in FIGS. 7-13, the second coupler 250 is also generally cylindrical and is formed to include an open pile receiving end 254 that receives an end of the pile 252. In a contemplated embodiment, the pile 252 is a hollow round shaft having an outer diameter of 2.875 inches that fits snugly in the pile receiving end 254 up to a short distance before reaching a smaller diameter stop 256 formed in the coupler 250. Greater or lesser outer diameters of shafts may be accommodated in other embodiments, however. The coupler 250 further includes a smaller diameter, hollow and round main body 258 extending from the pile receiving end 254.

The main body 258 is formed with central passageway or bore having an inner surface with an inner diameter about equal to, but slightly larger than the outer diameter of the main body 208 of the coupler 200. A tapered end 260 is formed in the coupler 250 that extends at a distance from an open distal end 264. The inner surface of the main body 258 is formed with a number of inwardly depending, spaced apart helically extending grooves 262. In the example shown, four helical grooves 262 are provided that are spaced about 90° apart from one another on the inner surface of the main body 258. The helical grooves 262 have a complementary size and shape to the helical ribs 212 of the coupler 200, and the helical grooves therefore also have large pitch that is equal to the pitch of the ribs 212 on the coupler 200, such that from a base of the open distal end 264 to the distal end of each groove 262 about a quarter turn of a helix is completed in each groove. The helical grooves 262 extend as thread-like members on the inner surface of the main body 258. While a specific geometry and specific number of helical grooves is shown and described, it is appreciated that alternative numbers and/or alternative geometries of grooves 262 is possible with otherwise similar benefits in other embodiments.

Figure 10:
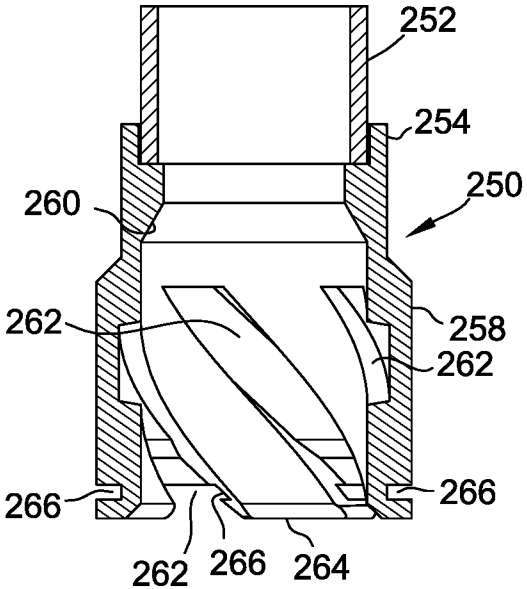
FIG. 10 is a cross sectional view of the second coupler and support shaft shown in FIG. 9.
Figure 9:
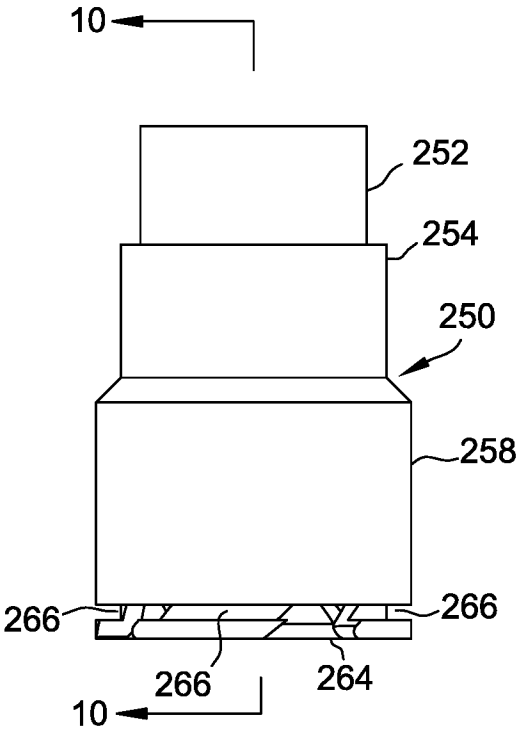
FIG. 9 is a side elevational view of the second coupler and support shaft shown in FIG. 8.
Figure 8:
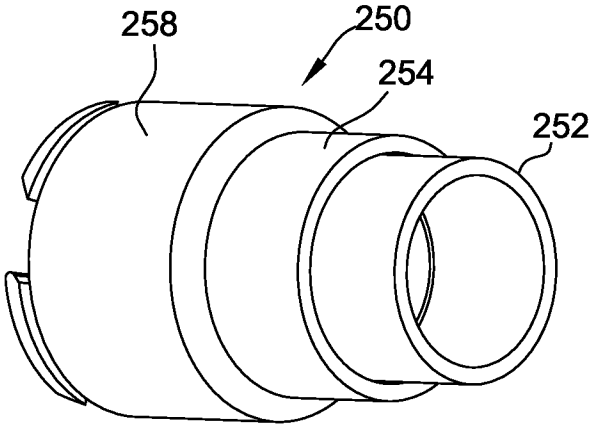
FIG. 8 is a perspective view of an exemplary embodiment of a second coupler and support shaft for a foundation support system according to the present invention.
Figure 13:
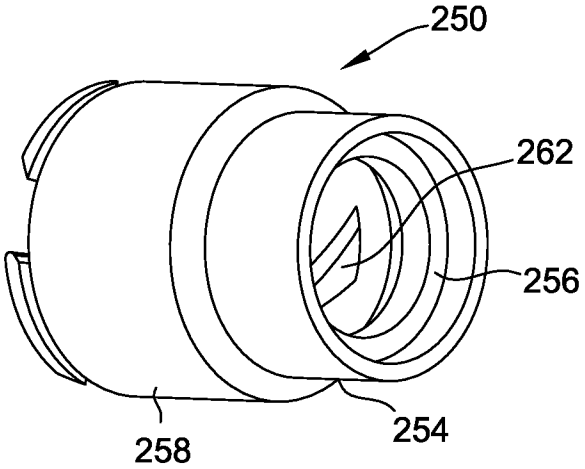
FIG. 13 is a perspective of the second coupler without the support shaft shown in FIG. 8.
Figure 11:
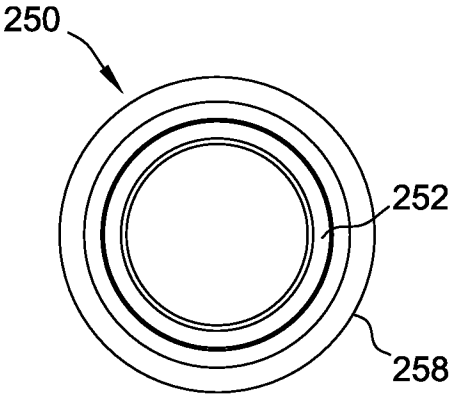
FIG. 11 is a first end view of the second coupler and support shaft shown in FIG. 9.
Figure 12:
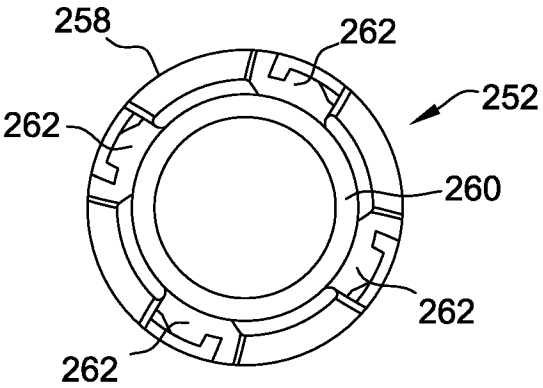
FIG. 12 is a second end view of the second coupler and support shaft shown in FIG. 9.

As best seen in FIG. 10, the coupler 250 also includes a circumferential retaining groove 266 formed in its outer surface adjacent the distal end 264. The retaining groove 266 is interrupted at the locations of the helical grooves 262. An annular spring retainer element 270 (FIGS. 14, 15, 16, 17) is received in and extend around the retaining groove 266 of the coupler 250, and extends across the retaining grooves 266. The spring retainer element 270 also extends around the circumference of the retaining groove 266 for a radial distance less than 360° in the example shown, and is generally planar in shape rather than helical in shape as a conventional spring would be. While one spring retainer element 270 is shown, more than one spring element could be provided with otherwise similar function and effect.

The spring retainer element 270 in a contemplated embodiment may be fabricated from a resiliently deflectable metal material, metal alloy or another suitable material allowing the spring retainer element 270 to elastically expand in the radial dimension from an initial diameter to a larger diameter when subjected to an outwardly directed force, and return to its initial diameter when the force outwardly directed force is removed. In some embodiments, the spring retainer element 270 may likewise grip the circumference of the retaining groove 266 with a predetermined amount of force in the initial position. Beneficially, the spring element 270 is permanently attached to the coupler 250 (i.e., the spring retainer element 270 is not intended to be removed) and is therefore integrated into the coupler design. This allows the coupler 250 to be provided to the installer with the spring retainer element 270 already in place, eliminating any need for an installer to locate a separately provided fastener (or fasteners) including but not necessarily limited to conventional bolts to attach piles to one another in conventional foundation support systems. Also, the spring retainer element 270 is pre-aligned in the retaining groove 266 such that the installer need not be concerned with the orientation of the spring retainer element 270 when assembling and installing the foundation support system.

Figure 16:
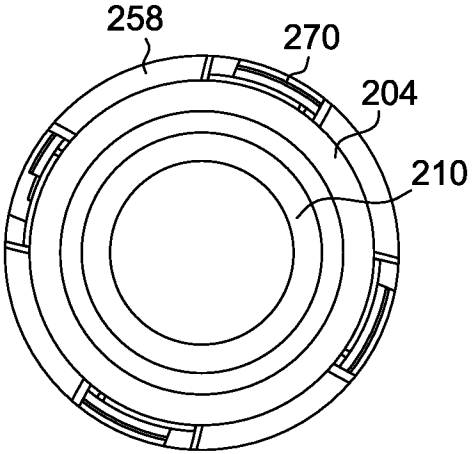
FIG. 16 is an end view of the mated components shown in FIG. 14.
Figure 14:
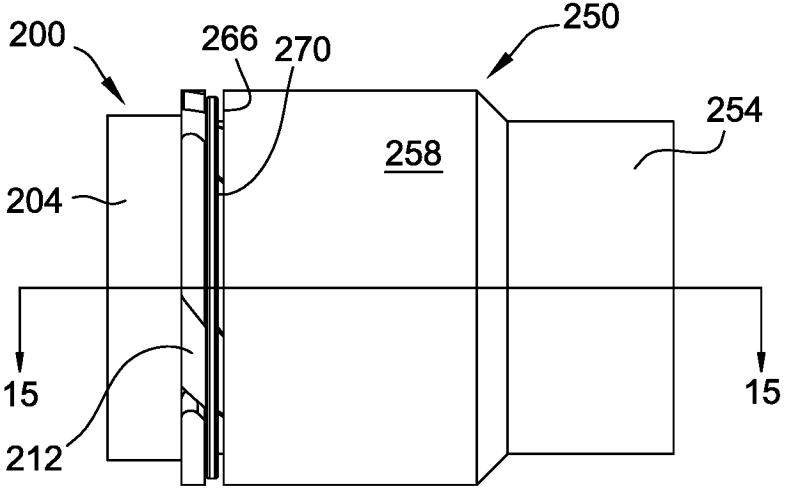
FIG. 14 is a side view of the first coupler and support shaft mated with the second coupler and support shaft.
Figure 15:
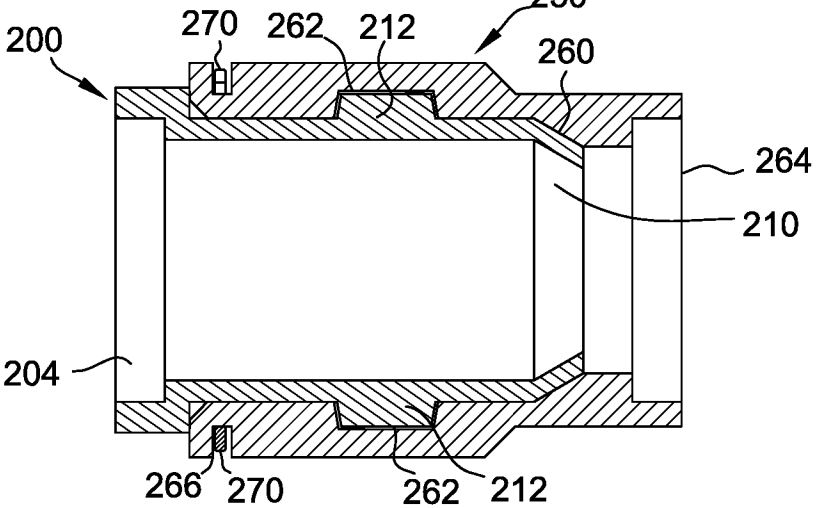
FIG. 15 is a cross sectional view of the mated components shown in FIG. 14.
Figure 17:
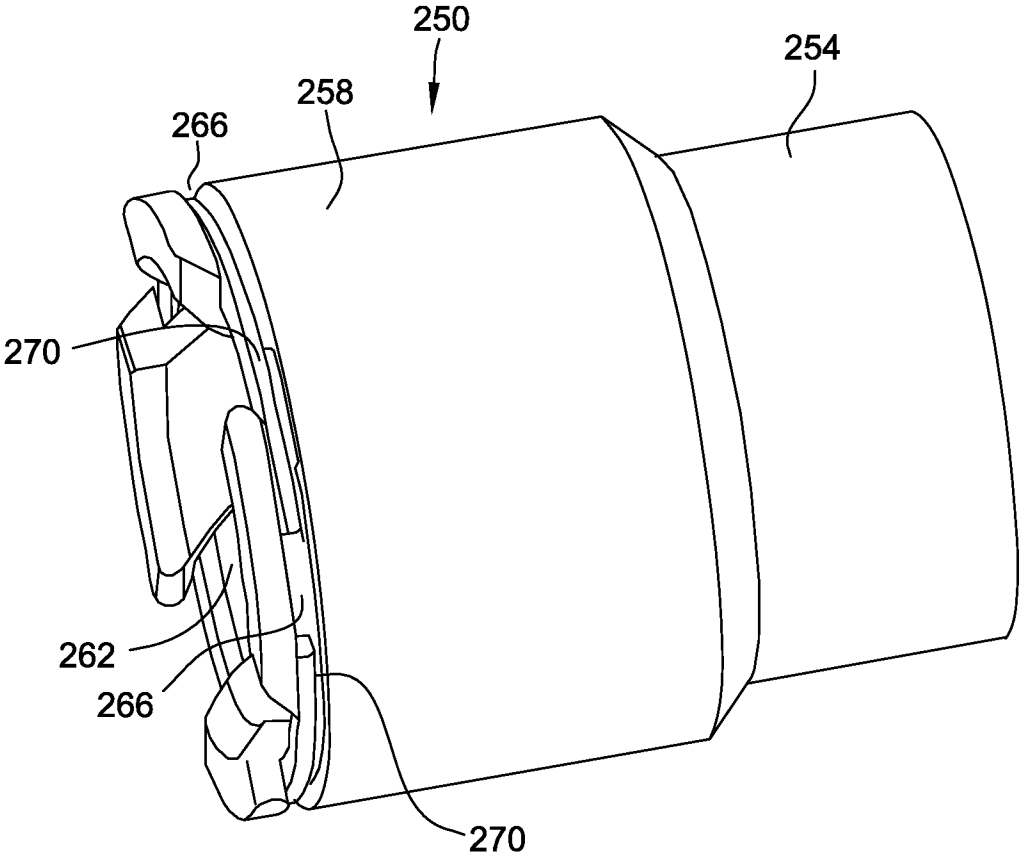
FIG. 17 is another perspective view of the second coupler shown in FIG. 13.
Figure 18:
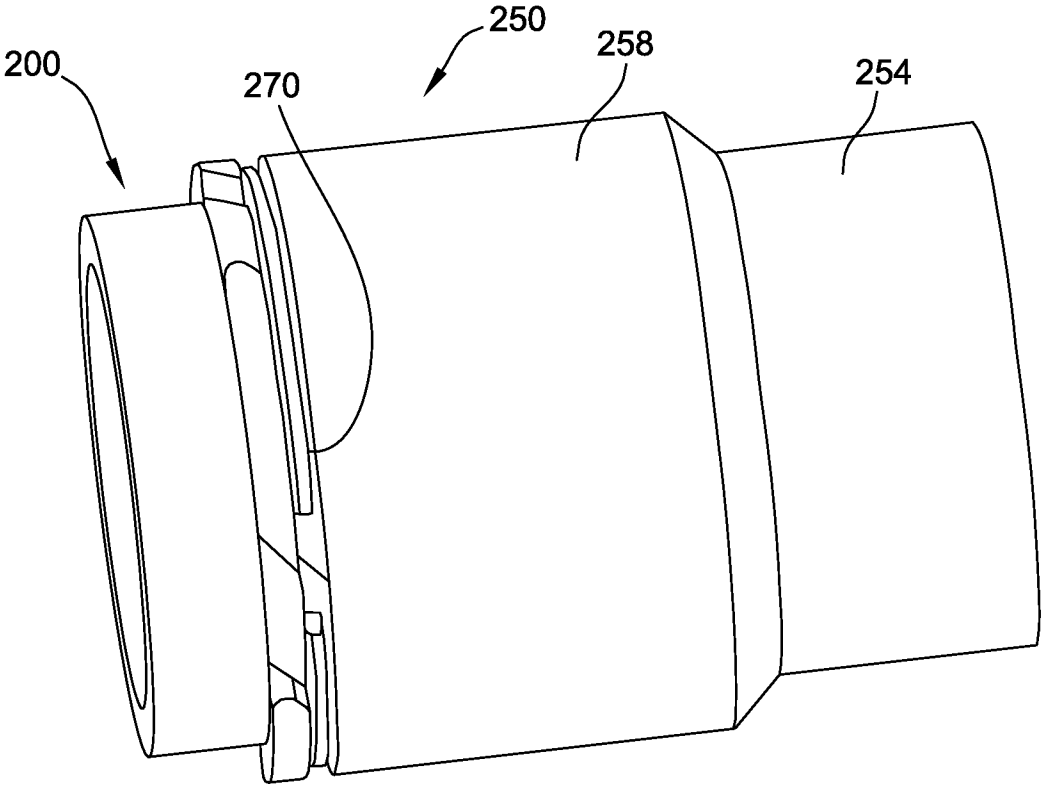
FIG. 18 is another perspective view of the second coupler shown in FIG. 17 when mated to the first coupler.

As illustrated in FIGS. 14-16, the spring retainer element 270 is resiliently deflectable in the radial direction when engaged by the ramps 214 in the ribs 212 of the coupler 200 as the ribs and the grooves in the couplers 250, 200 are engaged. The engagement of the ribs and the grooves may be simply made via partial insertion of the coupler 200 into the coupler 250 (or via partly inserting the coupler 250 over the coupler 200). After such partial engagement, the coupler that is partially inserted may be simply rotated relative to the other coupler that is fixed in place on the end of a pile that has been driven into the ground until the ribs fall into the grooves or until the grooves fall over the ribs, at which point the coupler being inserted will fall into engagement via gravitational force until the tapered ends 210, 260 seat or engage one another. Because the ribs and grooves are helical, vertical and rotational displacement of the coupler being inserted will occur relative to the other stationary coupler as the assembly is completed. Engagement of the tapered ends 210, 260 beneficially reduces "play" in the connection that may otherwise result. Reduction or elimination of play in the joint in turn tightens the joint to beneficially increase the rotational stiffness and reduce stress in the assembly.

Initially, the smaller outer diameter of the ribs 212 will pass by and through the spring retainer element 270. As the ribs and grooves are more fully received to complete the mating of the couplers 200, 250, the ramps 214 in the ribs make contact with the spring retainer element 270 and gradually enlarge and expand the diameter of the spring retainer element 270 as the ribs 212 continue to descend into the grooves 262 or vice versa. Given that the example couplers illustrated involve four ribs 212 being received in four grooves 262, the diameter of the spring retainer element 270 is enlarged at four locations to evenly expand the diameter of the spring element around the circumference of each of the couplers. The expansion of the spring retainer element 270 by the ribs 212 is further assisted by the combination of vertical and rotational movement of the ramps 214 as they make contact with the spring retainer element 270.

Once the expanded spring retainer element 270 clears the shoulder 216 in the ribs 212, the circumferential retaining grooves 218 in the ribs 212 of the coupler 200 now align with the retaining groove 266 of the coupler 250. The ribs 212 no longer contact the spring retainer element 270 as expanded, and the spring retainer element 270 now freely and resiliently returns back to a reduced diameter within the confines of the aligned retaining grooves 218 and 266 in the respective couplers 200, 250. Snap-action engagement is therefore accomplished via the self-alignment of the couplers 200, 250 and gravitational forces acting upon the spring retainer element 270 until the alignment of the retaining grooves 218 and 266 is obtained, wherein the spring retainer element 270 automatically engages and snaps into place without the installer having to take any specific action to complete the connection with a fastener such as a bolt.

Once engaged, the spring retainer element 270 provides an axial interlock of the engaged couplers 200, 250 while the ribs and grooves simultaneously provide both axial and rotational interlock of the couplers 200, 250. Because the helical ribs and grooves distribute any uplift forces in the mated outer and inner surfaces of the couplers, the spring retainer element 270 may be smaller and lighter than it otherwise may need to be if it exclusively bore all of the uplift forces that may be presented. The mated helical ribs 212 and grooves 262 in the couplers 200, 250 also provide secure rotational interlock to transmit torque in either direction (forward or reverse) to drive a piling deeper into the ground or to partially or completely withdraw it from the ground, without requiring a separately fastener such as a bolt to complete the torque transmitting connection.

If and when desired, a tool or tools such as a screwdriver(s) may be used to pry the spring retainer element 270 open (i.e., enlarge its diameter) until it clears the shoulders 216 in the ribs and therefore allow the ribs 212 to disengaged from the grooves 262 and the couplers 200, 250 to be separated from one another in the axial direction. In certain contemplated embodiments, a custom-fabricated tool may be supplied to disengage the snap-lock spring element in an easier manner when desired.

When mated together as described the couplers 200, 250 may rather simply slidably engage one another in a manner that does not require precise positioning for an installed to complete the connection with a separately provided fastener. That is, for the exemplary embodiments illustrated, one of the couplers 200, 250 positioned above the other may be partly inserted into the other (or over the other) and gently rotated until the ribs 212 and grooves 262 become aligned with one another. Thereafter, the coupler positioned above will rather naturally fall into place as the ribs and grooves receive one another with slidable movement occurring simultaneously in each of the axial and rotational directions.

The snap-lock connection, via the retaining spring element 270, is automatically established once the couplers 200, 250 reach a predetermined amount or degree of engagement determined by the positions of the ramps 214 and the clearance shoulders 216, and also by the locations of the retaining grooves 218, 266 in the couplers 200, 250. Such locations are predetermined so that the retaining spring retainer element 270 snaps into place just after, or at about the same time, as the ribs 212 and grooves 262 become fully engaged. The spring element 270, once engaged in the retaining grooves 218, 266, establishes a positive interlocking engagement in combination with the ribs 212 and grooves 262 of the couplers 200, 250 in rotational and axial directions. As used herein, the axial direction refers to a direction that is parallel to an axial centerline of the couplers 200, 250 (e.g., a vertical centerline in the views of FIGS. 3, 4, 9 and 10 as drawn), while the rotational direction refers to a simple rotation or spinning about the axial centerline of the couplers while the axial centerline itself remains in place. The axial centerline of each coupler, in turn, coincides with a longitudinal axis of the respective piles 202, 252 being connected.

In one example embodiment, the first coupler 200 is attached to a first pile (either a primary pile or an extension pile) that has been driven into the ground and is therefore fixed in position at a location just above the surface of the ground, and the second coupler 250 is attached to a second pile (an extension pile) that is to be connected to the first pile. In another embodiment, however, the second coupler 250 is attached to a first pile (either a primary pile or an extension pile) that has been driven into the ground and is therefore fixed in position at a location just above the surface of the ground, and the first coupler 200 is attached to a pile (an extension pile) that is to be connected to the first pile. Either way, the couplers 200, 250 provide positive interlocking in the rotational direction to transmit torque between the couplers 200, 250 to drive the first and second piles 202, 252 into the ground, while positive locking in the axial interlocking afforded by the retaining spring element 270 distributes uplift forces whenever present and ensures that the couplers 200, 250 remain engaged at all times.

Via the couplers 200, 250, neither fastener holes nor bolts are required to complete the connections of the piles 202, 252 and the drawbacks of conventional bolts and fastener holes are avoided while otherwise providing a highly reliable foundation support system. Additionally, through-holes need not be formed in the couplers 200, 250 to receive fasteners such as bolts, and the manufacture of the couplers 200, 250 may accordingly be simplified. Difficulties and reliability issues associated with through-holes are avoided. Expenses of threaded fasteners and/or threaded fastener holes are likewise avoided, as are installation difficulties presented by threaded fasteners or holes.

While exemplary embodiments of couplers 200, 250 are illustrated and described, numerous variations are possible. For example, instead of outwardly depending ribs projecting from an outer surface in one coupler and inwardly depending grooves extending on an inner surface of the other coupler, contemplated embodiments could instead include grooves extending on an outward surface on one coupler and projecting ribs extending from an inner surface of the other coupler. Likewise, each of the couplers could include a combination of ribs and grooves to be mated within complementary ribs and grooves in the other coupler, instead of only ribs being provided in one coupler and only grooves being provided in the other.

While helical ribs and grooves in the couplers 200, 250 are beneficial for the reasons stated, the snap-lock action could be realized with ribs and grooves that are not helical. So long as the ramps are provided to engage the retaining spring retainer element 270 and so long as retaining grooves 218, 266 are provided in each coupler, the snap-lock engagement can be obtained regardless of the actual shape of the ribs or grooves. Likewise, ramps or other features serving to extend the diameter of the spring element and/or the retaining grooves could be employed on portions of the couplers other than the ribs as described above in relation to the coupler 200. It is recognized that similar snap-lock functionality may be achieved in different portions of the couplers and the examples shown and described are set forth for illustration rather than limitation.

The couplers 200, 250 in different embodiments may be separately provided and attached to primary piles or extension piles, or in other cases may be integrally formed with the piles themselves via, for example only, casting, swaging or forging processes. In some cases, couplers 200 and 250 may be pre-attached to both ends of the same pile or otherwise formed on the opposing ends of the same pile, or alternatively only one coupler may be provided only on one end of a pile.

The cross-sectional shape of the piles attachable through the couplers 200, 250 can be circular, square, hexagonal, or another shape as desired via modification of the pile receiving openings on the ends of the couplers 200, 250. Likewise, couplers 200, 250 can be adapted for use to attach one type of pile (e.g., having a round cross section) to another type of pile having a different cross section (e.g., square). Likewise, piles of different diameters can be coupled through the couplers 200, 250 when the couplers are adapted to receive the piles of each diameter.

The piles 202, 252 can be made to different lengths as the application requires, or provided as modular sets of shafts having predetermined lengths that can be assembled to create a piling including coupled shafts of any desired length. Such shafts of different lengths may be prefabricated to include the couplers 200, 250 such that the modular shafts can be mixed and matched on site as needs dictate, avoiding otherwise custom fabrication of shafts to non-standard lengths that has conventionally been employed.

The piles connected through the couplers 200, 250 can be hollow or filled with a substance such as concrete, chemical grout, or another known suitable cementitious material or substance familiar to those in the art to enhance the structural strength and capacity of the pilings in use. The pilings may be prefilled with cementitious material in certain contemplated embodiments.

Likewise, in other contemplated embodiments, cementitious material, including but not necessarily limited to grout material familiar to those in the art, may be mixed into the soil around the piles as they are being driven into the ground, creating a column of cementitious material around the pilings for further structural strength and capacity to support a building foundation. Grout and cementitious material may be pumped through the hollow pilings under pressure as the pilings are advanced into the ground, causing the hollow pilings to fill with grout, some of which is released exterior to the pilings to mix with the soil at the installation site. Openings and the like can be formed in the piles to direct a flow of cementitious material through the piles and at selected locations into the surrounding soil.

The couplers 200, 250 may facilitate a modular assembly of piles as well as other components in a foundation support system (e.g., helical auger elements, tapered ends or cutting ends, lift brackets, support brackets, support caps, and drive elements for coupling to machinery utilized to generate the torque to drive the pilings into the ground) that are provided with complementary ribs or grooves to quickly complete connections in the installation of a foundation support system. Also, various sizes of couplers 200, 250 may be provided to attach foundation support system components other than primary pile and extension piles as needed or desired. Different versions of couplers and components can be provided in kit form for selective use by an installer to create a number of different variations of foundation support systems using a relatively small number of modular parts.

While described in the context of foundation support systems and support piles therefore, it is recognized that the couplers 200, 250 may be utilized to connect other structural shaft elements in another application apart from foundation support that presents similar issues and/or that would confer similar benefits. The foregoing description is therefore provided for the sake of illustration rather than limitation. That is, the shafts being connected with the couplers 200, 250 need not be shafts of piles or piers or any of the components shown and described in the foundation support system described above, but instead the shafts may be other structural elements for other purposes. Provided that the ends of the structural elements being connected are shaped to complement the features of the couplers 200, 250 the structural elements need not even necessarily be shafts.

FIGS. 19-23 illustrate another embodiment of a snap-lock coupler assembly 300 that may be used in lieu of or in addition to the coupler assembly including the couplers 200, 250 described and illustrated in FIGS. 1-18 in a foundation support system. The coupler assembly 300 provides at least some of the same benefits to those described above but with different torque transmitting features.

Figure 19:
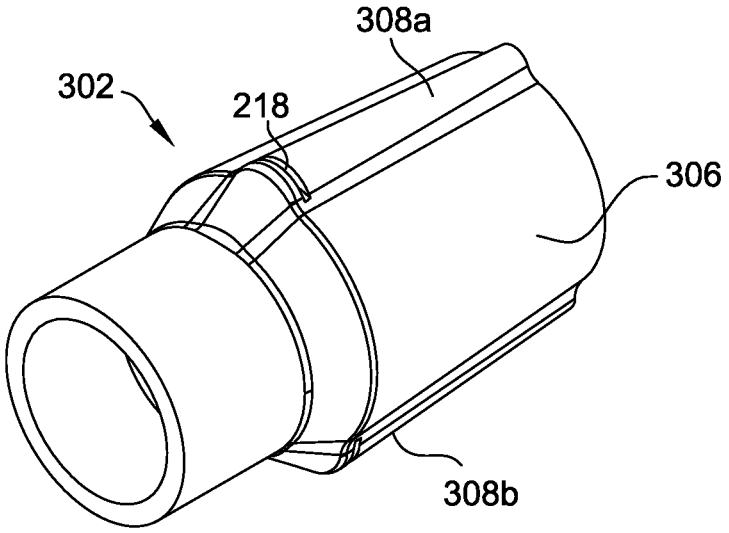
FIG. 19 is a perspective view of another exemplary embodiment of a first coupler for a foundation support system according to the present invention.
Figure 20:
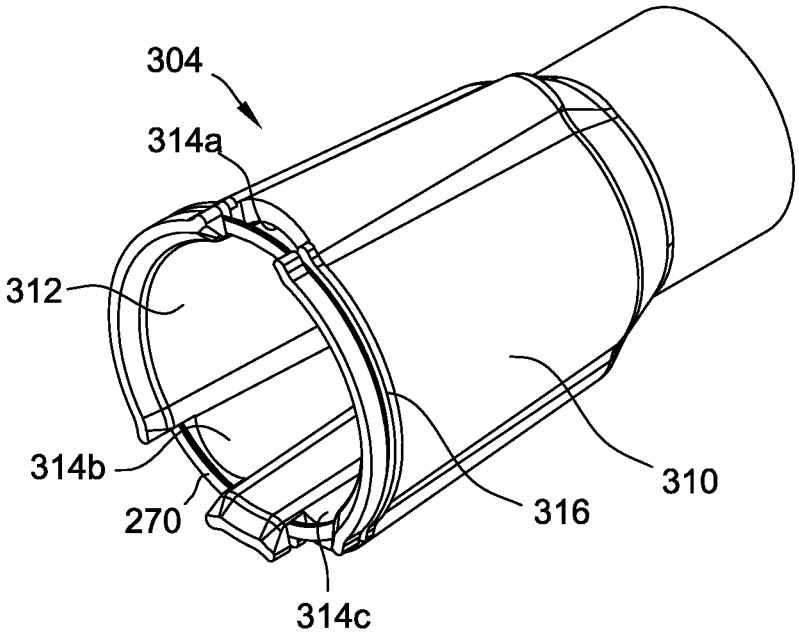
FIG. 20 is a perspective view of another exemplary embodiment of a second coupler for use with the first coupler shown in FIG. 19.

As shown, the coupler assembly 300 (FIGS. 21-23) includes a first coupler 302 (FIG. 19) and a second coupler 304 (FIG. 20). Each of the first and second couplers 302, 304 are attachable to foundation support elements such as primary piles and extension piles as described above. Following the above example, the coupler 302, sometimes referred to as a male coupler, is attachable to the first pile 202 (FIGS. 2-7) and the second coupler 304, sometimes referred to as a female coupler, is attachable to a second pile 252 (FIGS. 8-13). The couplers 302, 304 may be separately manufactured from the piles 202, 252 in certain embodiments, and thereafter attached to each pile 202, 252 in a known manner, including but not necessarily limited to welding. Alternatively, the couplers 302, 304 may be integrally formed on respective ends of the piles 202, 252 via casting, forging and swaging processes instead of separately provided and attached elements. The couplers 200, 250 and the piles 202, 252 may each be fabricated from high strength steel or another suitable material according to known techniques. Like the couplers 200, 250 the couplers 302, 304 may be utilized in lieu of conventional couplers designed for bolted connections to piles in a foundation support system like the system 100 described above to provide the desired support to a building foundation, but with a much simpler, quicker and more reliable installation.

The first coupler 302 (FIGS. 19, 21 and 22) includes a hollow, cylindrical and rounded main body 306 that is formed with a number of outwardly projecting spaced apart and longitudinally extending ribs 308*a*, 308*b* and 308*c*. In the example shown, three generally elongated, linearly extending ribs 308, 308*b* and 308*c* are provided that extend axially on the main body 306 and are spaced unevenly apart from one another on the rounded main body 306. Unlike the helical ribs described above in the couplers 200, 250, the linearly extending ribs 308*a*, 308*b*, 308*c* have no pitch and therefore do not extend as thread-like members on the outer surface of the main body 306.

Figure 21:
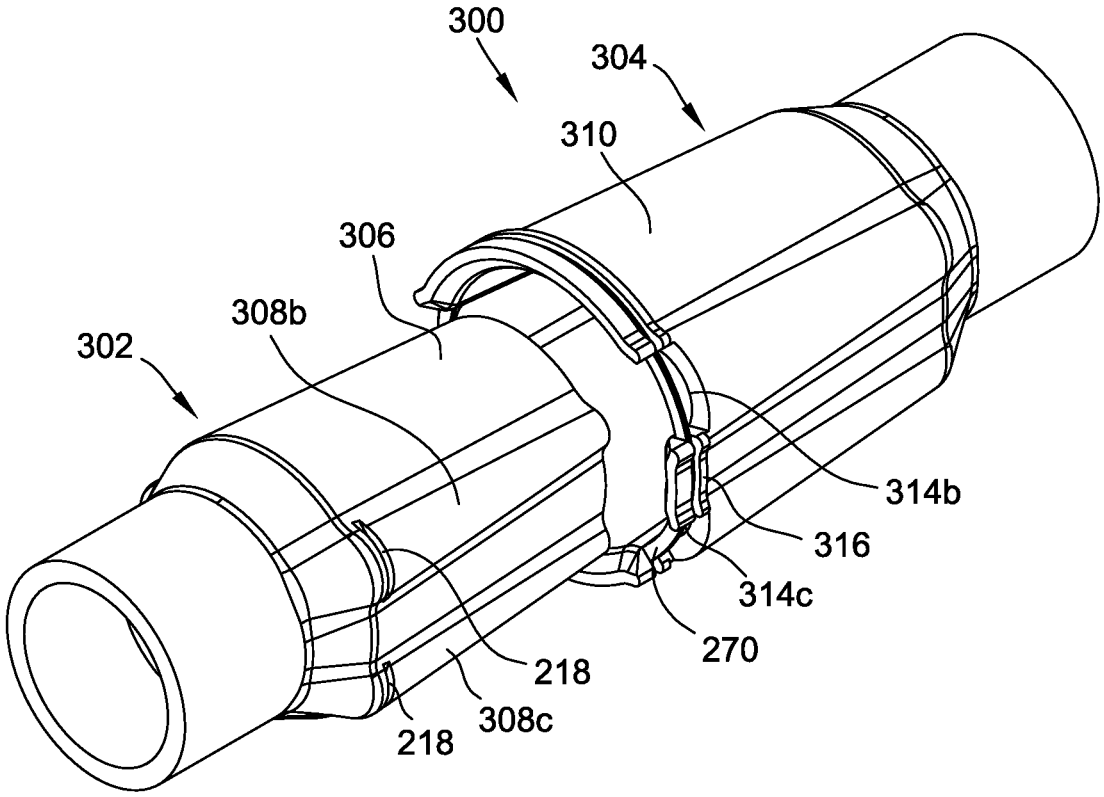
FIG. 21 is a perspective assembly view of the first and second couplers shown in FIGS. 19 and 20.
Figure 22:
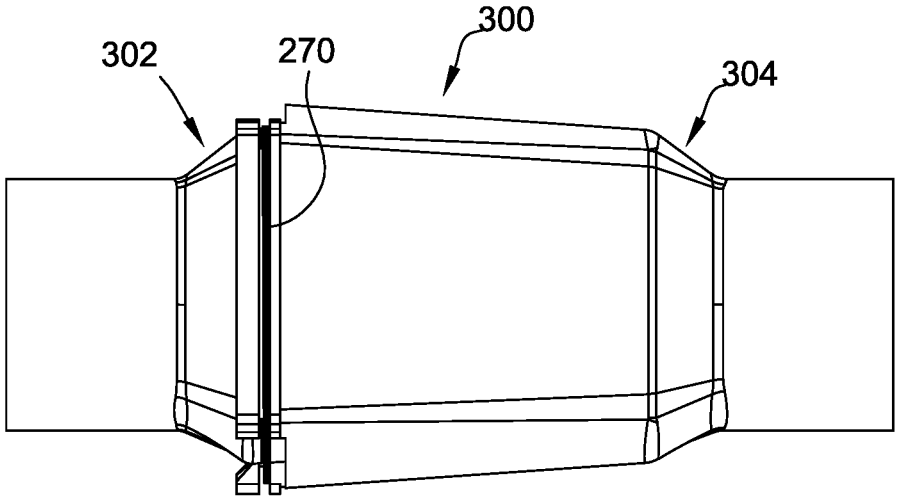
FIG. 22 is a side view of the mated first and second couplers shown in FIG. 21.
Figure 23:
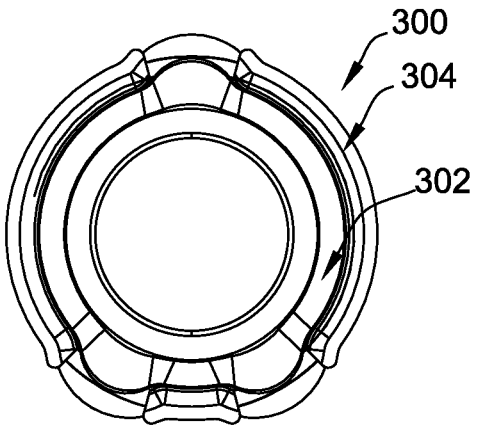
FIG. 23 is an end view of the mated first and second couplers shown in FIG. 21.

In the example shown, and as best seen in FIGS. 19 and 21, the ribs 308*b* and 308*c* on the main body 306 of the coupler 302 are relatively close to one another while also being spaced from the rib 308*a* by a relatively large amount on the circumference of the main body 306. The main body 306 is also tapered in the axial direction such that its outer circumference gradually decreases along the axial centerline of the main body 306 toward its distal end that is slidably inserted into the second coupler 304 as shown in FIGS. 21 and 22. The ribs 308*a*, 308*b* and 308*c* are also tapered in the widthwise direction such that the width of the ribs gradually decreases along the axial centerline of each rib 308*a*, 308*b* and 308*c* toward the distal open end of the first coupler 302 that is slidably inserted into the second coupler 304 as shown in FIGS. 21 and 22.

The second coupler 304 is also formed to include a hollow, cylindrical and round main body 310. The main body 310 is formed with a central passageway or bore 312 having an inner surface with an inner diameter about equal to, but slightly larger than the outer diameter of the main body 306 of the coupler 302. The inner surface is formed with a number of inwardly depending, spaced apart linearly extending grooves 314*a*, 314*b*, 314*c* having a complementary size and shape to the ribs 308*a*, 308*b* and 308*c* of the first coupler 302. The main body 310 and grooves 314*a*, 314*b*, 314*c* are tapered to receive the main body 306 and the ribs 308*a*, 308*b* and 308*c* as the couplers are mated as shown in FIGS. 21 and 22. The axial tapering of each coupler 302, 304 allows the couplers to be easily mated with one another in a self-aligning manner via initial insertion of the smaller diameter distal end of the coupler 302 into the larger diameter distal end of the coupler 304 with the ribs and grooves more gradually mating with one another as the couplers are more fully mated, culminating in a snug engagement when the couplers are fully mated.

The coupler 304 also includes a circumferential retaining groove 316 formed in its outer surface, and the annular spring retainer element 270 is received in and extends around the retaining groove 316 of the coupler 304. The spring retainer element 270 is permanently attached to the coupler 304 (i.e., the spring retainer element 270 is not intended to be removed from the coupler 304) and is therefore integrated into the coupler design and provides similar benefits to those described above.

As the ribs 308*a*, 308*b* and 308*c* are mated with the grooves 314*a*, 314*b*, 314*c* the spring retainer element 270 is eventually engaged by the ribs once the ribs and grooves are engaged to a predetermined degree. Engagement of the ribs to the spring retainer element 270, in turn, causes a gradual enlargement and expansion of the inner diameter of the spring retainer element 270. Once the expanded spring retainer element 270 clears the retaining grooves 218 in the ribs 308*a*, 308*b* and 308*c* as the couplers are further mated, the ribs no longer contact the spring retainer element 270 as expanded and the spring retainer element 270 now freely and resiliently returns back to a reduced diameter within the confines of the aligned retaining grooves 218 and 316 in each of the couplers 302, 304. An automatic, snap-action engagement of the couplers 302, 304 is therefore accomplished with benefits similar to that described above. Engagement of the axially tapered main bodies 306, 310 in the couplers 302, 304 beneficially reduces "play" in the connection that may otherwise result. Reduction or elimination of play in the joint in turn tightens the joint to beneficially increase the rotational stiffness and reduce stress in the assembly.

Relative to the couplers 200, 250 including helical ribs and grooves, the couplers 302, 304 include simpler shaped ribs and grooves and also a reduced number of ribs and grooves and therefore may be provided at lower cost. Axial interlocking is automatically established by the spring retainer element 270 while rotational interlocking is established via the ribs and grooves in the couplers 302, 304. Since axial interlocking is borne by the spring retainer element 270 in this embodiment, a larger and higher cost retaining spring retainer element 270 may be required relative to the couplers 200, 250.

Figure 24:
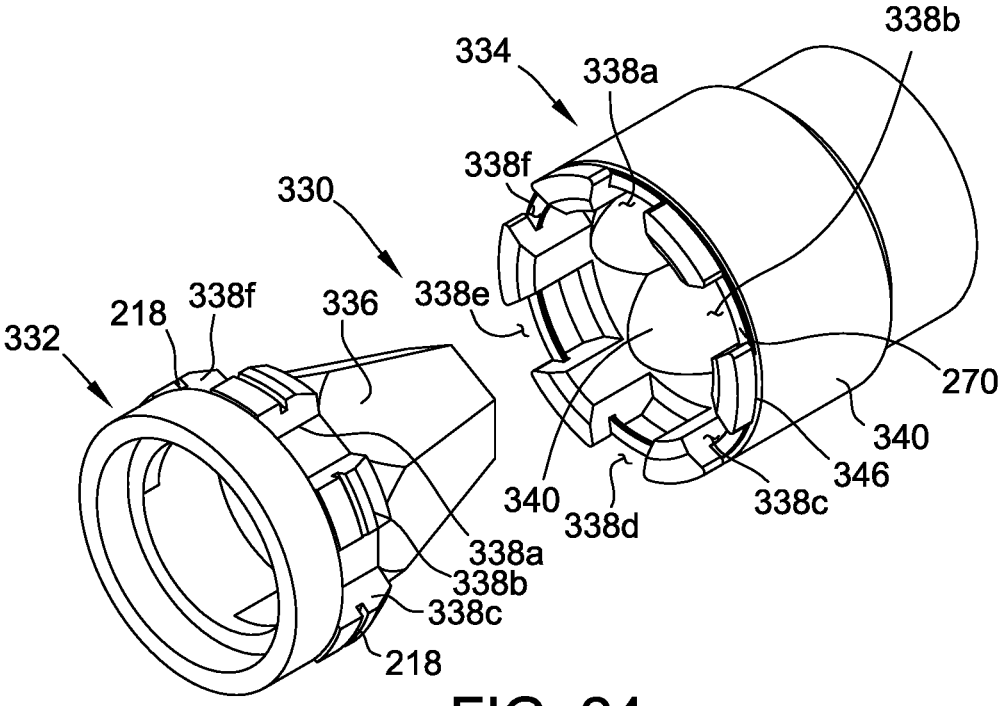
FIG. 24 is a first perspective assembly view of another embodiment of first and second couplers for a foundation support system according to the present invention.
Figure 25:
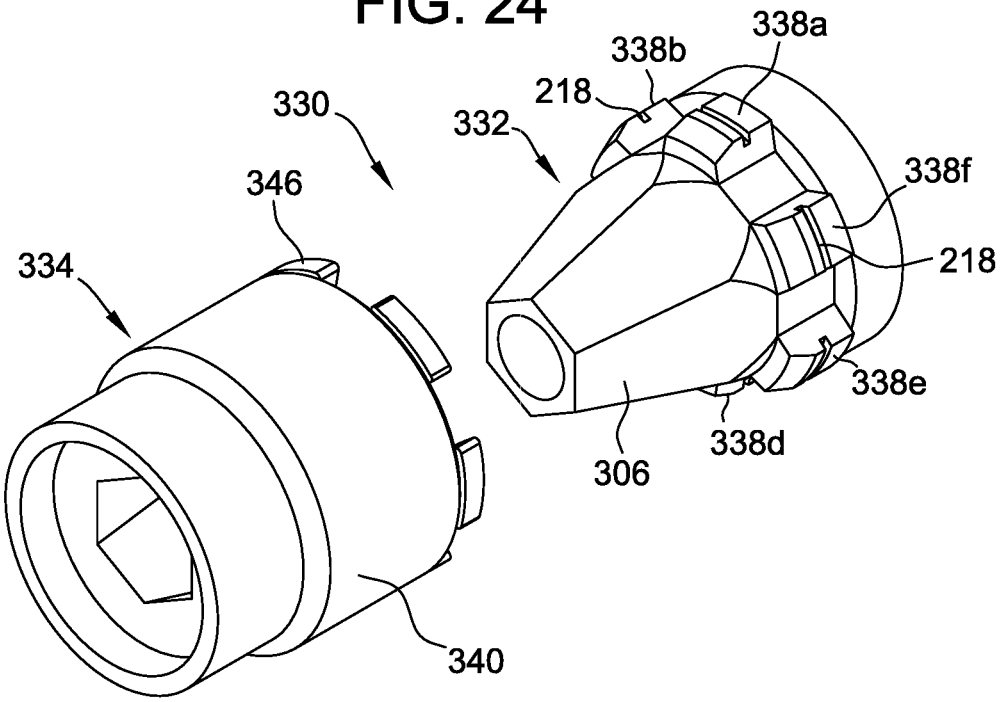
FIG. 25 is a second perspective assembly view of the couplers shown in FIG. 24.
Figure 26:
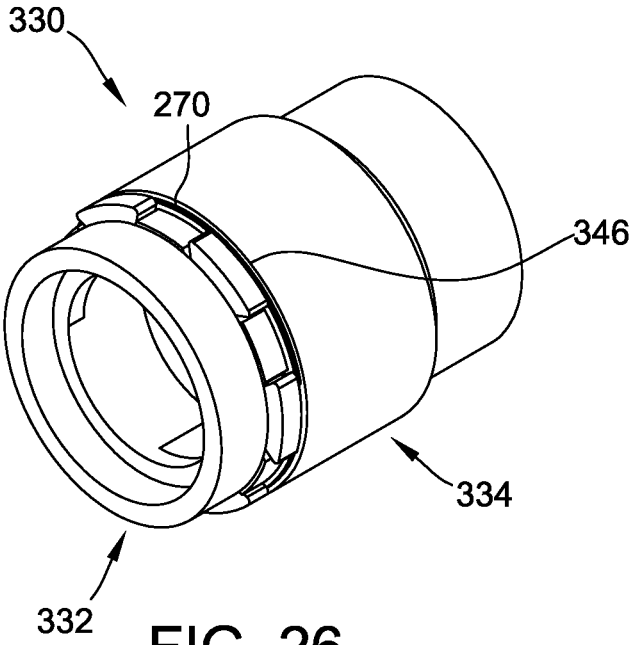
FIG. 26 is an end view of the mated first and second couplers shown in FIGS. 24 and 25.

FIGS. 24-26 illustrate another embodiment of a snap-lock coupler assembly 330 that may be used in lieu of or in addition to the coupler assemblies described above in a foundation support system. The coupler assembly 330 provides at least some of the same benefits to those described above but with different torque transmitting features.

As shown in the figures, the coupler assembly 330 includes a first coupler 332 and a second coupler 334. Each of the first and second couplers 332, 334 are attachable to foundation support elements such as primary piles and extension piles as described above. Following the above example, the coupler 332, sometimes referred to as a male coupler, is attachable to the first pile 202 (FIGS. 2-7) and the second coupler 334, sometimes referred to as a female coupler, is attachable to a second pile 252 (FIGS. 8-13). The couplers 332, 334 may be separately manufactured from the piles 202, 252 in certain embodiments, and thereafter attached to each pile 202, 252 in a known manner, including but not necessarily limited to welding. Alternatively, the couplers 332, 334 may be integrally formed on respective ends of the piles 202, 252 via casting, forging and swaging processes instead of separately provided and attached elements. The couplers 332, 354 and the piles 202, 252 may each be fabricated from high strength steel or another suitable material according to known techniques. Like the couplers 200, 250 the couplers 332, 334 may be utilized in lieu of conventional couplers designed for bolted connections to piles in a foundation support system like the system 100 described above to provide the desired support to a building foundation, but with a much simpler, quicker and more reliable installation.

The first coupler 332 includes a hollow, polygonal (i.e., non-rounded) main body 336 that is formed with a number of outwardly projecting spaced apart and longitudinally extending ribs 338*a*, 338*b*, 338*c*, 338*d*, 338*e* and 338*f* at an end of the main body 336. The polygonal main body 336 is hexagonal in the example shown (i.e., has six sides) with six truncated axial and linearly extending ribs 338*a*, 338*b*, 338*c*, 338*d*, 338*e* and 338*f* extending over the intersection of each side of the polygonal outer surface. The ribs 338*a*, 338*b*, 338*c*, 338*d*, 338*e* and 338*f* are spaced evenly from one another on the main body 336. Unlike the helical ribs described above, the linearly extending ribs 338*a*, 338*b*, 338*c*, 338*d*, 338*e* and 338*f* have no pitch and therefore do not extend as thread-like members on the outer surface of the main body 336. The main body 336 is also tapered such that its outer circumference gradually decreases along the axis of the main body 336 toward its distal open end that is inserted into the second coupler 304 as shown. The tapered main body 336 provides ease of assembly, with the hexagonal sides being self-aligning with mating surfaces of the second coupler 334 while the couplers 332, 334 are mated.

The second coupler 334 is formed to include a hollow and round main body 340. The main body 340 is formed with central passageway or bore 342 having an inner surface with an inner circumference about equal to, but slightly larger than the outer circumference of the main body 336 of the coupler 332. The inner surface is formed with a hexagonal receiving area and a number of inwardly depending, spaced apart linearly extending grooves 344*a*, 344*b*, 344*c*, 344*d*, 344*e* and 334*f* having a complementary size and shape to the ribs 338*a*, 338*b*, 338*c*, 338*d*, 338*e* and 338*f* of the first coupler 332.

The coupler 334 also includes a circumferential retaining groove 346 formed in its outer surface, and the annular spring retainer element 270 is received in and extends around the retaining groove 346 of the coupler 334. The spring retainer element 270 is permanently attached to the coupler 334 (i.e., the spring retainer element 270 is not intended to be removed from the coupler 334) and is therefore integrated into the coupler design and provides similar benefits to those described above.

As the ribs 338*a*, 338*b*, 338*c*, 338*d*, 338*e* and 338*f* are mated with the grooves 344*a*, 344*b*, 344*c*, 344*d*, 344*e* and 334*f* the spring retainer element 270 is eventually engaged by the ribs once a predetermined degree of mating engagement of the couplers 332, 334 has been accomplished. The engagement of the ribs to the spring retainer element 270 thereafter causes the spring retainer element 270 to gradually enlarge and the inner diameter of the spring retainer element 270 is expanded as the couplers are further engaged to one another. Once the expanded spring retainer element 270 clears the retaining grooves 218 in the ribs 338*a*, 338*b*, 338*c*, 338*d*, 338*e* and 338*f* the ribs no longer contact the spring retainer element 270 as expanded, and the spring retainer element 270 now freely and resiliently returns back to a reduced diameter within the confines of the aligned retaining grooves 218 and 346 in each of the couplers. Automatic, snap-action engagement is therefore accomplished with benefits similar to that described above. Engagement of the tapered main bodies 336, 340 in the couplers 332, 334 beneficially reduces "play" in the connection that may otherwise result. Reduction or elimination of play in the joint in turn tightens the joint to beneficially increase the rotational stiffness and reduce stress in the assembly.

Relative to the couplers 200, 250 including helical ribs and grooves, the couplers 302, 304 include smaller and simpler shaped ribs and grooves, albeit a larger number of ribs and grooves. The hexagonal feature reduces material in the coupler 332 relative to the coupler 250, but complicates the structure of the coupler 334 relative to the coupler 250. Axial interlocking is automatically established by the spring retainer element 270 while rotational interlocking is established via the ribs and grooves in the couplers 332, 334 and also the polygonal surfaces of the mated couplers 332, 334. Since axial interlocking is borne by the spring retainer element 270 in this embodiment, a larger and higher cost retaining spring retainer element 270 may be required relative to the couplers 200, 250.

Figure 27:
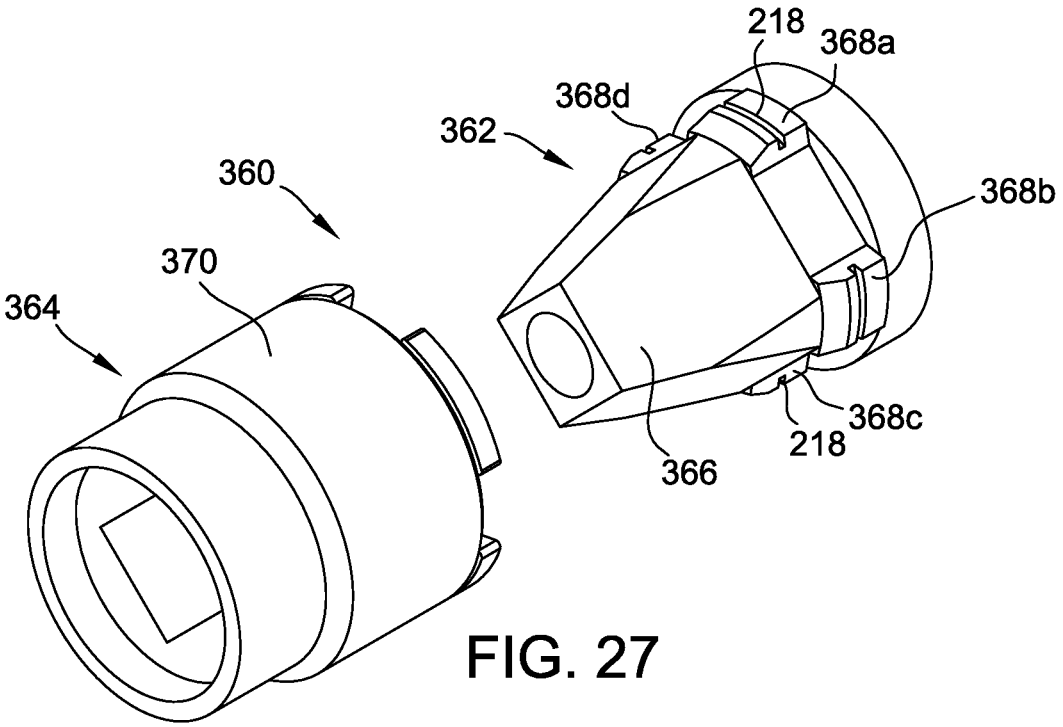
FIG. 27 is a first perspective assembly view of another embodiment of first and second couplers for a foundation support system according to the present invention.
Figure 28:
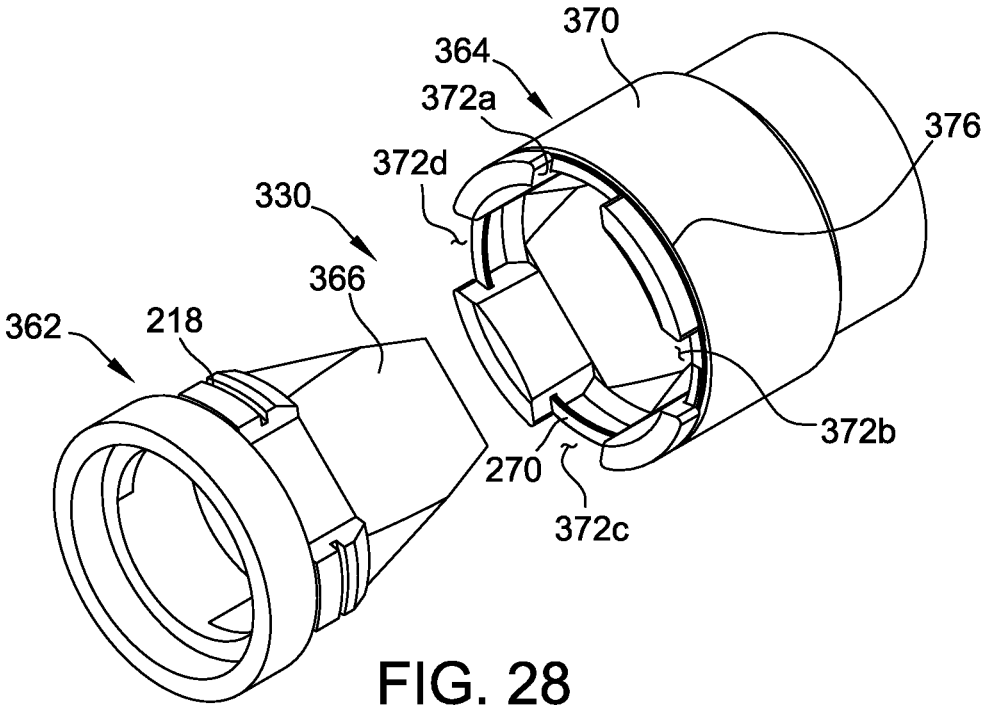
FIG. 28 is a second perspective assembly view the couplers shown in FIG. 27.
Figure 29:
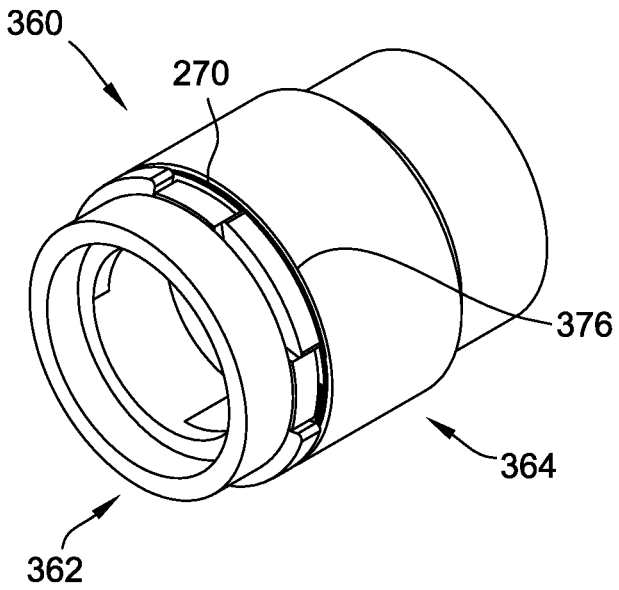
FIG. 29 is an end view of the mated first and second couplers shown in FIGS. 27 and 28.

FIGS. 27-29 illustrate another embodiment of a snap-lock coupler assembly 360 that may be used in lieu of or in addition to the coupler assemblies described above in a foundation support system. The coupler assembly 360 provides at least some of the same benefits to those described above but with different torque transmitting features. Like features of the coupler assembly 360 and the previously described coupler assemblies are indicated with like reference characters in FIGS. 27-29.

As shown in the figures, the coupler assembly 360 includes a first coupler 362 and a second coupler 364. Each of the first and second couplers 362, 364 are attachable to foundation support elements such as primary piles and extension piles as described above. Following the above example, the coupler 362, sometimes referred to as a male coupler, is attachable to the first pile 202 (FIGS. 2-7) and the second coupler 364, sometimes referred to as a female coupler, is attachable to a second pile 252 (FIGS. 8-13). The couplers 362, 364 may be separately manufactured from the piles 202, 252 in certain embodiments, and thereafter attached to each pile 202, 252 in a known manner, including but not necessarily limited to welding. Alternatively, the couplers 362, 364 may be integrally formed on respective ends of the piles 202, 252 via casting, forging and swaging processes instead of separately provided and attached elements. The couplers 362, 364 and the piles 202, 252 may each be fabricated from high strength steel or another suitable material according to known techniques. Like the couplers 200, 250 the couplers 362, 364 may be utilized in lieu of conventional couplers designed for bolted connections to piles in a foundation support system like the system 100 described above to provide the desired support to a building foundation, but with a much simpler, quicker and more reliable installation.

The first coupler 362 includes a hollow, polygonal (i.e., non-rounded) main body 366 that is formed with a number of outwardly projecting spaced apart and longitudinally extending ribs 368*a*, 368*b*, 368*c* and 368*d* at an end of the main body 366. The polygonal main body 366 is square in the example shown (i.e., has four sides) with four truncated linearly extending ribs 368*a*, 368*b*, 368*c* and 368*d* extending over the intersection of each side of the polygonal outer surface. The ribs 368*a*, 368*b*, 368*c* and 368*d* are spaced evenly from one another on the main body 366. Unlike the helical ribs described above, the linearly extending ribs 368*a*, 368*b*, 368*c*, 368*d* have no pitch and therefore do not extend as thread-like members on the outer surface of the main body 366. The main body 366 is also tapered such that its outer circumference gradually decreases along the axial centerline of the main body 366 toward its distal end that is slidably inserted into the second coupler 364 as shown.

The second coupler 364 is formed to include a hollow and round main body 370. The main body 370 is formed with central passageway or bore 372 having an inner surface with an inner circumference about equal to, but slightly larger than the outer circumference of the main body 366 of the coupler 362. The inner surface is formed with a tapered square receiving surface and a number of inwardly depending, spaced apart linearly extending grooves 374*a*, 374*b*, 374*c* and 374*d* having a complementary size and shape to the ribs 368*a*, 368*b*, 368*c* and 368*d* of the first coupler 362.

The coupler 364 also includes a circumferential retaining groove 376 formed in its outer surface, and the annular spring retainer element 270 is received in and extends around the retaining groove 376 of the coupler 364. The spring retainer element 270 is permanently attached to the coupler 364 (i.e., the spring retainer element 270 is not intended to be removed from the coupler 364) and is therefore integrated into the coupler design and provides similar benefits to those described above.

As the ribs 368*a*, 368*b*, 368*c* and 368*d* are mated with the grooves 374*a*, 374*b*, 374*c* and 374*d* the spring retainer element 270 is eventually engaged by the ribs which gradually enlarge and expand the diameter of the spring retainer element 270. As the couplers 362, 364 are further engaged, once the expanded spring retainer element 270 clears the retaining grooves 218 in the ribs 368*a*, 368*b*, 368*c* and 368*d* the ribs no longer contact the spring retainer element 270 as expanded, and the spring retainer element 270 now freely and resiliently returns back to a reduced diameter within the confines of the aligned retaining grooves 218 and 376 in each of the couplers. Automatic, snap-action engagement is therefore accomplished with benefits similar to that described above. Engagement of the tapered main bodies 366, 370 in the couplers 362, 364 beneficially reduces "play" in the connection that may otherwise result. Reduction or elimination of play in the joint in turn tightens the joint to beneficially increase the rotational stiffness and reduce stress in the assembly.

Relative to the couplers 332, 334 described above, the couplers 362, 364 are more simply shaped and includes fewer ribs and grooves and therefore may be provided at lower cost with otherwise similar benefits.

Figure 30:
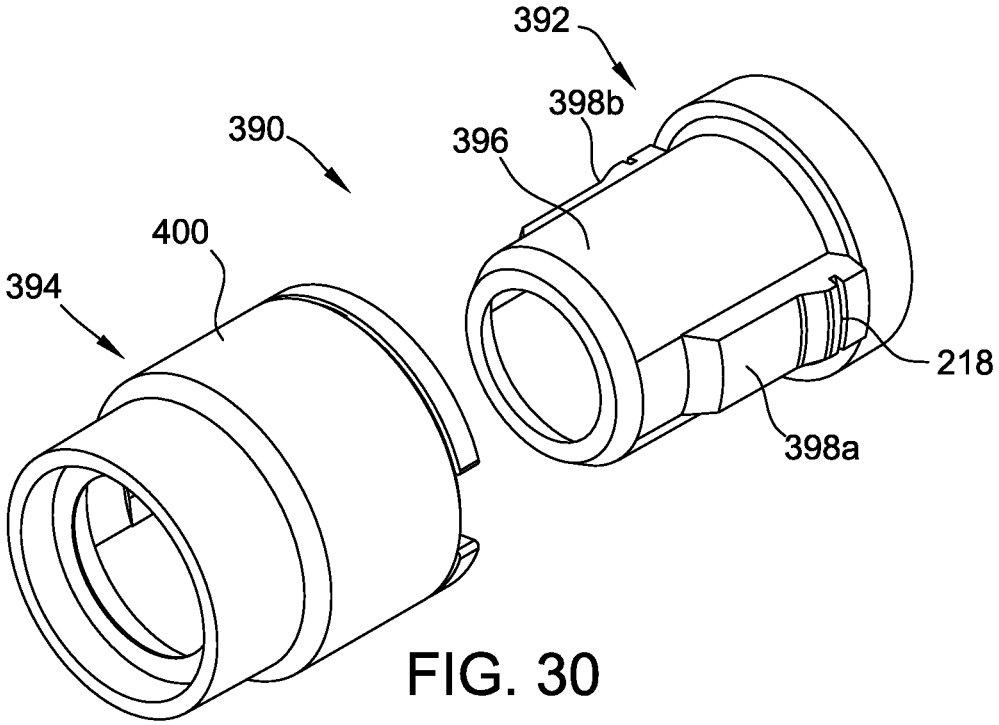
FIG. 30 is a first perspective assembly view of another embodiment of first and second couplers for a foundation support system according to the present invention.
Figure 31:
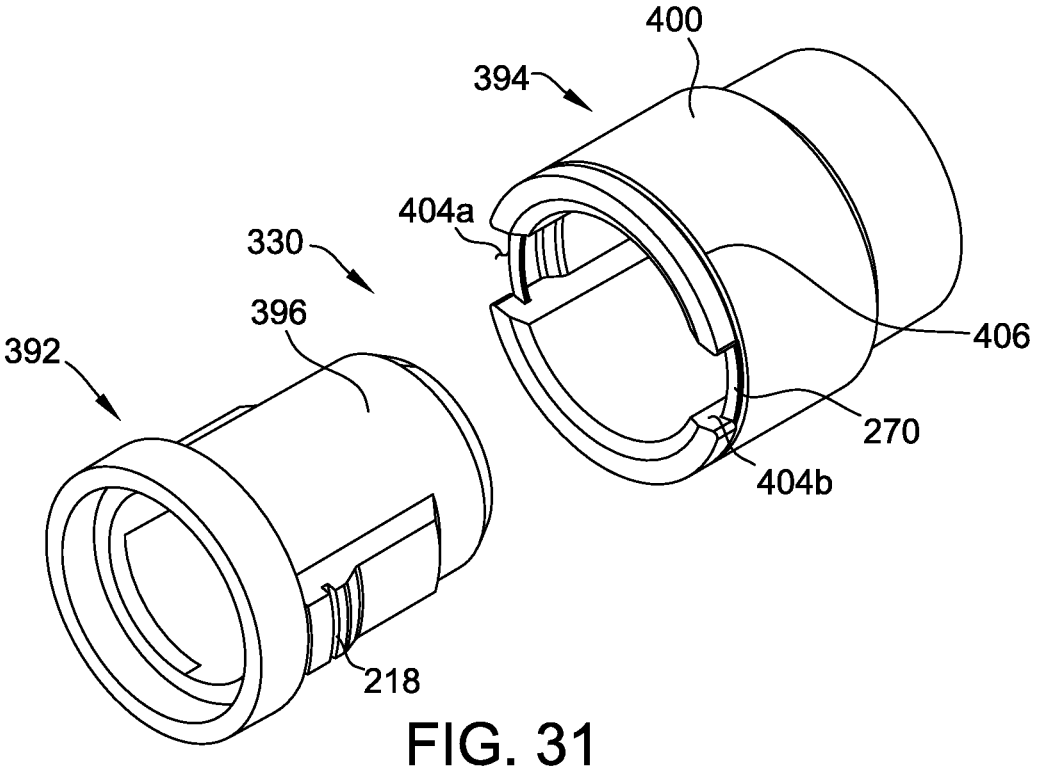
FIG. 31 is a second perspective assembly view of the first and second couplers shown in FIG. 30.
Figure 32:
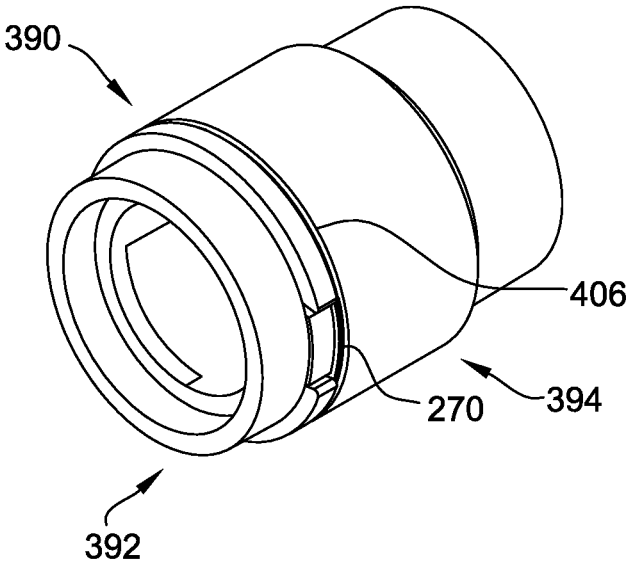
FIG. 32 is an end view of the mated first and second couplers shown in FIGS. 31 and 32.

FIGS. 30-32 illustrate another embodiment of a snap-lock coupler assembly 390 that may be used in lieu of or in addition to the coupler assemblies described above in a foundation support system. The coupler assembly 390 provides at least some of the same benefits to those described above but with different torque transmitting features. Like features of the coupler assembly 390 and the previously described coupler assemblies are indicated with like reference characters in FIGS. 30-32.

As shown in the figures, the coupler assembly 390 includes a first coupler 392 and a second coupler 394. Each of the first and second couplers 392, 394 are attachable to foundation support elements such as primary piles and extension piles as described above. Following the above example, the coupler 392, sometimes referred to as a male coupler, is attachable to the first pile 202 (FIGS. 2-7) and the second coupler 394, sometimes referred to as a female coupler, is attachable to a second pile 252 (FIGS. 8-13). The couplers 392, 394 may be separately manufactured from the piles 202, 252 in certain embodiments, and thereafter attached to each pile 202, 252 in a known manner, including but not necessarily limited to welding. Alternatively, the couplers 392, 394 may be integrally formed on respective ends of the piles 202, 252 via casting, forging and swaging processes instead of separately provided and attached elements. The couplers 392, 394 and the piles 202, 252 may each be fabricated from high strength steel or another suitable material according to known techniques. Like the couplers 200, 250 the couplers 392, 394 may be utilized in lieu of conventional couplers designed for bolted connections to piles in a foundation support system like the system 100 described above to provide the desired support to a building foundation, but with a much simpler, quicker and more reliable installation.

The first coupler 392 includes a hollow, cylindrical and rounded main body 396 that is formed with a number of outwardly projecting spaced apart and longitudinally extending ribs 398*a* and 398*b*. The ribs 398*a*, 398*b* are spaced evenly from one another on the main body 396. Unlike the helical ribs described above, the linearly extending ribs 398*a*, 398*b* have no pitch and therefore do not extend as thread-like members on the outer surface of the main body 396.

The second coupler 394 is formed to include a hollow and round main body 400. The main body 400 is formed with central passageway or bore 402 having an inner surface with an inner circumference about equal to, but slightly larger than the outer circumference of the main body 396 of the coupler 392. The inner surface is formed with a number of inwardly depending, spaced apart linearly extending grooves 404*a* and 404*b* having a complementary size and shape to the ribs 398*a*, 398*b* of the first coupler 392.

The coupler 394 also includes a circumferential retaining groove 406 formed in its outer surface, and the annular spring retainer element 270 is received in and extends around the retaining groove 406 of the coupler 394. The spring retainer element 270 is permanently attached to the coupler 394 (i.e., the spring retainer element 270 is not intended to be removed from the coupler 394) and is therefore integrated into the coupler design and provides similar benefits to those described above.

As the ribs 398*a*, 398*b* are mated with the grooves 404*a*, 404*b* the spring retainer element 270 is eventually engaged by the ribs which gradually enlarge and expand the diameter of the spring retainer element 270 as the couplers are further mated to one another. Once the expanded spring retainer element 270 clears the retaining grooves 218 in the ribs 398*a*, 398*b*, the ribs no longer contact the spring retainer element 270 as expanded, and the spring retainer element 270 now freely and resiliently returns back to a reduced diameter within the confines of the aligned retaining grooves 218 and 406 in each of the couplers. Automatic, snap-action engagement is therefore accomplished with benefits similar to that described above.

Optionally, the main body of each coupler may be axially tapered like some of the couplers described above to beneficially simplify ease of assembly in a self-aligning manner while still reducing "play" in the connection that may otherwise result. Reduction or elimination of play in the joint in turn tightens the joint to beneficially increase the rotational stiffness and reduce stress in the assembly.

Figure 33:
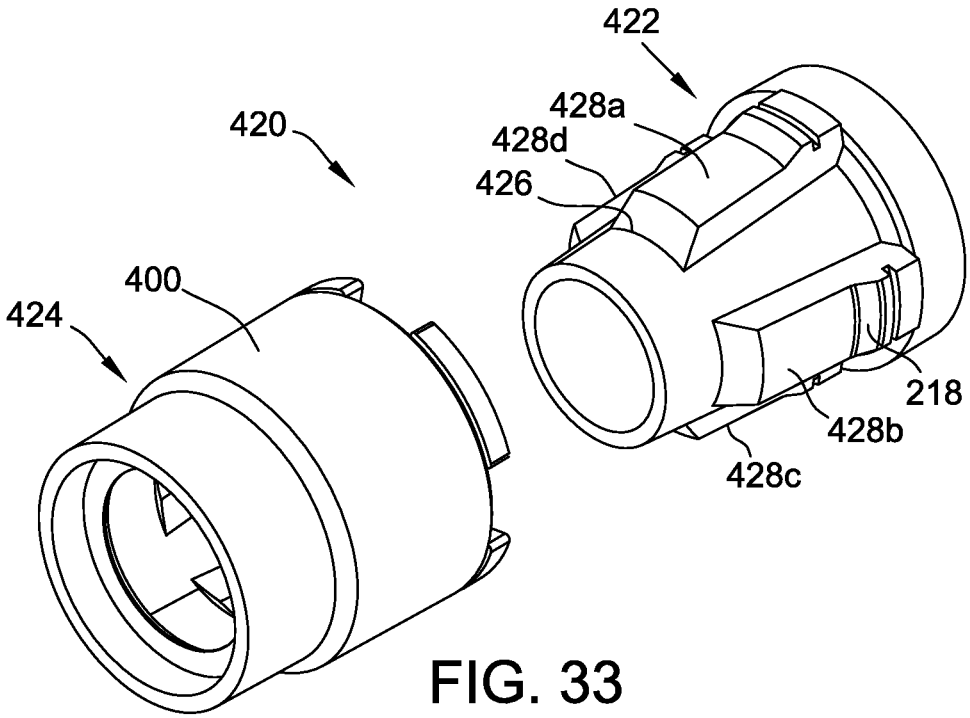
FIG. 33 is a first perspective assembly view of another embodiment of first and second couplers for a foundation support system according to the present invention.
Figure 34:
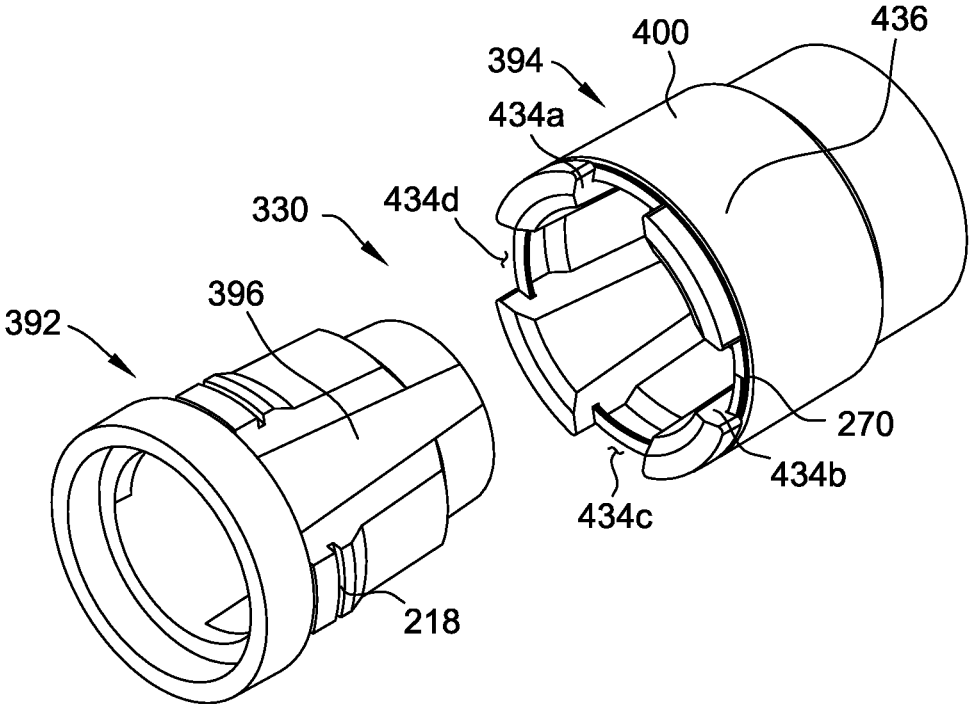
FIG. 34 is a second perspective assembly view of the first and second couplers shown in FIG. 33.
Figure 35:
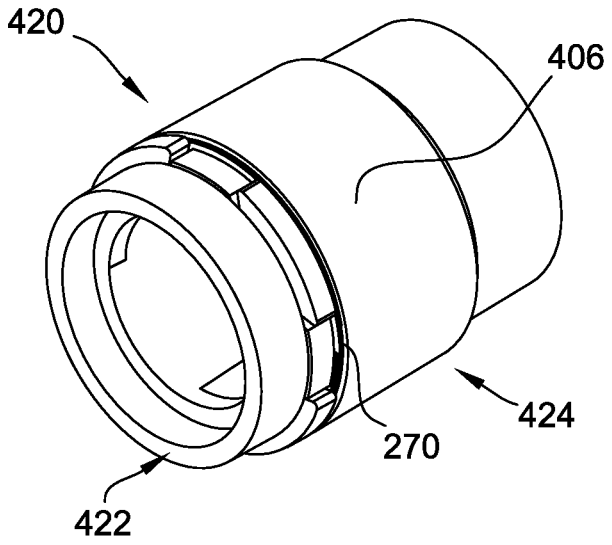
FIG. 35 is an end view of the mated first and second couplers shown in FIGS. 33 and 34.

FIGS. 33-35 illustrate another embodiment of a snap-lock coupler assembly 420 that may be used in lieu of or in addition to the coupler assemblies described above in a foundation support system. The coupler assembly 420 provides at least some of the same benefits to those described above but with different torque transmitting features. Like features of the coupler assembly 420 and the previously described coupler assemblies are indicated with like reference characters in FIGS. 33-35.

As shown in the figures, the coupler assembly 420 includes a first coupler 422 and a second coupler 424. Each of the first and second couplers 422, 424 are attachable to foundation support elements such as primary piles and extension piles as described above. Following the above example, the coupler 422, sometimes referred to as a male coupler, is attachable to the first pile 202 (FIGS. 2-7) and the second coupler 494, sometimes referred to as a female coupler, is attachable to a second pile 252 (FIGS. 8-13). The couplers 422, 424 may be separately manufactured from the piles 202, 252 in certain embodiments, and thereafter attached to each pile 202, 252 in a known manner, including but not necessarily limited to welding. Alternatively, the couplers 422, 424 may be integrally formed on respective ends of the piles 202, 252 via casting, forging and swaging processes instead of separately provided and attached elements. The couplers 422, 424 and the piles 202, 252 may each be fabricated from high strength steel or another suitable material according to known techniques. Like the couplers 200, 250 the couplers 422, 424 may be utilized in lieu of conventional couplers designed for bolted connections to piles in a foundation support system like the system 100 described above to provide the desired support to a building foundation, but with a much simpler, quicker and more reliable installation.

The first coupler 422 includes a hollow, rounded main body 426 that is formed with a number of outwardly projecting spaced apart and axially extending ribs 428*a*, 428*b*, 428*c* and 428*b*. The ribs 428*a*, 428*b*, 428*c* and 428*d* are spaced evenly from one another on the main body 426. Unlike the helical ribs described above, the linearly extending ribs 428*a*, 428*b*, 428*c* and 428*b* have no pitch and therefore do not extend as thread-like members on the outer surface of the main body 426. The axially extending ribs 428*a*, 428*b*, 428*c* and 428*b* are further tapered in the axial direction as shown.

The second coupler 424 is formed to include a hollow and round main body 430. The main body 430 is formed with central passageway or bore 432 having an inner surface with an inner circumference about equal to, but slightly larger than the outer circumference of the main body 426 of the coupler 422. The inner surface is formed with a number of inwardly depending, spaced apart linearly extending grooves 434*a*, 434*b*, 434*c* and 434*b* having a complementary size and shape to the ribs 428*a*, 428*b*, 428*c* and 428*b* of the first coupler 422.

The coupler 424 also includes a circumferential retaining groove 436 formed in its outer surface, and the annular spring retainer element 270 is received in and extends around the retaining groove 436 of the coupler 324. The spring retainer element 270 is permanently attached to the coupler 424 (i.e., the spring retainer element 270 is not intended to be removed from the coupler 424) and is therefore integrated into the coupler design and provides similar benefits to those described above.

As the ribs 428*a*, 428*b*, 428*c* and 428*b* are mated with the grooves 434*a*, 434*b*, 434*c* and 434*d* the spring retainer element 270 is eventually engaged by the ribs which gradually enlarge and expand the diameter of the spring retainer element 270. Once the expanded spring retainer element 270 clears the retaining grooves 218 in the ribs 428*a*, 428*b*, 428*c* and 428*b*, the ribs no longer contact the spring retainer element 270 as expanded, and the spring retainer element 270 now freely and resiliently returns back to a reduced diameter within the confines of the aligned retaining grooves 218 and 436 in each of the couplers. Automatic, snap-action engagement is therefore accomplished with benefits similar to that described above. The tapered ribs and grooves of each coupler provide simple and self-alignment of the couplers while beneficially reducing "play" in the connection that may otherwise result. Reduction or elimination of play in the joint in turn tightens the joint to beneficially increase the rotational stiffness and reduce stress in the assembly.

The couplers shown and described in relation to FIGS. 19-35 may be modified to reverse the arrangement of ribs and grooves on the couplers, or to include combinations of ribs and grooves in each coupler while still realizing similar effects and benefits. While a number of exemplary shapes and geometries are shown in the exemplary couplers described and illustrated, others are still possible while realizing similar effects and advantages.

It should be realized that aspects of the coupler assemblies described may be combined to provide still further variants of coupler assemblies realizing similar effects and advantages. As one example, the couplers 200, 250 including the helical ribs and grooves could be provided with axial tapered features in the main bodies and in the ribs and grooves. As another example, the polygonal mating surfaces could be provided without the axial taper in some of the embodiments described. Numerous variations are possible in this regard to realize varying degrees of self-alignment and axial interlocking at various price points.

It should also be realize that some aspects of the coupler assemblies described may be omitted to produce further variants of couplers at different price points. For example, the automatic snap-lock feature does not necessarily require a self-alignment feature in the couplers, and as such the self-alignment features may be omitted for certain end use of the couplers while still providing the axial interlocking benefits with simplified assembly. Other variations are likewise possible by omitting some of the features described in the exemplary embodiments while otherwise realizing some of the benefits provided by remaining features.

In some cases, couplers such as those shown in FIGS. 19-35 may be pre-attached to both ends of the same pile or otherwise formed on the opposing ends of the same pile, or alternatively only one coupler may be provided only on one end of a pile. The cross-sectional shape of the piles attachable through the couplers shown in FIGS. 19-35 can be circular, square, hexagonal, or another shape as desired via modification of the pile receiving openings on the ends of the couplers. Likewise, the couplers shown in FIGS. 19-29 can be adapted for use to attach one type of pile (e.g., having a round cross section) to another type of pile having a different cross section (e.g., square). Likewise, piles of different diameters can be coupled through the couplers shown in FIGS. 19-35 when the couplers are adapted to receive the piles of each diameter.

The piles 202, 252 including couplers as shown in FIGS. 19-35 can be made to different lengths as the application requires, or provided as modular sets of shafts having predetermined lengths that can be assembled to create a piling including coupled shafts of any desired length. Such shafts of different lengths may be prefabricated to include the couplers such that the modular shafts can be mixed and matched on site as needs dictate, avoiding otherwise custom fabrication of shafts to non-standard lengths that has conventionally been employed.

The piles connected through the couplers shown in FIGS. 19-36 can be hollow or filled with a substance such as concrete, chemical grout, or another known suitable cementitious material or substance familiar to those in the art to enhance the structural strength and capacity of the pilings in use. The pilings may be prefilled with cementitious material in certain contemplated embodiments.

Likewise, in other contemplated embodiments, cementitious material, including but not necessarily limited to grout material familiar to those in the art, may be mixed into the soil around the piles as they are being driven into the ground, creating a column of cementitious material around the pilings for further structural strength and capacity to support a building foundation. Grout and cementitious material may be pumped through the hollow pilings under pressure as the pilings are advanced into the ground, causing the hollow pilings to fill with grout, some of which is released exterior to the pilings to mix with the soil at the installation site. Openings and the like can be formed in the piles to direct a flow of cementitious material through the piles and at selected locations into the surrounding soil.

The couplers shown in FIGS. 19-35 may facilitate a modular assembly of piles as well as other components in a foundation support system (e.g., helical auger elements, tapered ends or cutting ends, lift brackets, support brackets, support caps, and drive elements for coupling to machinery utilized to generate the torque to drive the pilings into the ground) that are provided with complementary ribs or grooves to quickly complete connections in the installation of a foundation support system. Also, various sizes of couplers may be provided to attach foundation support system components other than primary pile and extension piles as needed or desired. Different versions of couplers and components can be provided in kit form for selective use by an installer to create a number of different variations of foundation support systems using a relatively small number of modular parts.

While described in the context of foundation support systems and support piles therefore, it is recognized that the couplers shown in FIGS. 19-35 may be utilized to connect other structural shaft elements in another application apart from foundation support that presents similar issues and/or that would confer similar benefits. The foregoing description is therefore provided for the sake of illustration rather than limitation. That is, the shafts being connected with the couplers shown in FIGS. 19-35 need not be shafts of piles or piers or any of the components shown and described in the foundation support system described above, but instead the shafts may be other structural elements for other purposes. Provided that the ends of the structural elements being connected are shaped to complement the features of the couplers shown in FIGS. 19-35 the structural elements need not even necessarily be shafts. The benefits and advantages of the inventive concepts described herein are now believed to have been amply illustrated in relation to the exemplary embodiments disclosed.

An embodiment of a foundation support system has been disclosed including a first coupler, a second coupler configured to rotationally interlock with the first coupler, and a spring retainer element configured to automatically engage and axially interlock the first coupler and the second coupler with snap-fit engagement as the first and second couplers are mated. The axial interlock avoids a separation of the first and second couplers at a below ground location due to axially directed uplift forces when the foundation support system is installed in a building site to support the foundation.

Optionally, each of the first and second couplers may include a plurality of ribs or a plurality of grooves, with the plurality of ribs and the plurality of grooves being rotationally interlocked when the first and second couplers are mated. The plurality of ribs may be respectively formed with a retainer groove, and the retainer groove may receive a portion of the spring retainer element with snap-fit engagement when the first and second couplers are mated. The plurality of ribs or the plurality of grooves may include a plurality of helical ribs or a plurality of helical grooves. Each helical rib or helical groove may complete only about ¼ turn on a surface of the respective first or second coupler. The first coupler may include four helical ribs and the second coupler may include four helical grooves.

As further options, the spring retainer element may be permanently attached to one of the first and second couplers. The spring retainer element may reside within a circumferential groove of one of the first and second couplers. The spring retainer element may be a planar element fabricated from a resiliently deflectable material, and further may be an annular element having an expandable inner diameter.

As still further options, each of the plurality of ribs may include a first portion having a first outer diameter passing through an initial inner diameter of the spring retainer element when the first and second couplers are partly mated. Each of the plurality of ribs further may also be formed with a ramp at an end of the first portion, and the ramp in each rib may contact the inner diameter of the spring retainer element and expand the initial inner diameter of the spring retainer element to a larger diameter when the first and second couplers are further mated. Each of the plurality of ribs may further be formed with a second portion having a second outer diameter greater than the first outer diameter, the second outer diameter passing through the larger inner diameter of the spring retainer element when the first and second couplers are further mated. Each of the plurality of ribs may also be formed with a retainer groove in the second portion, and the spring retainer element may resiliently return back to the initial diameter in the respective retaining grooves of the plurality of ribs when the first and second couplers are fully mated. As further options, the plurality of ribs or the plurality of grooves may include a plurality of linear ribs or a plurality of linear grooves. The plurality of ribs may include three ribs spaced unevenly from one another. Each of the first coupler and the second coupler may include a main body, with the plurality of ribs or the plurality of grooves extending on the main body of the first coupler and the second coupler. The main body of one of the first coupler and the second coupler may be polygonal, and more specifically may be hexagonal or square. The main body may also be axially tapered, and the ribs or grooves may also be axially tapered.

The main body of the first coupler and the second coupler may also each be round, and the main body of the first coupler and the second coupler may each be tapered. Alternatively, the main body of the first coupler may be non-round and wherein the main body of the second coupler may be round. The main body of the first coupler may be polygonal, and the ribs may be located at an intersection of each side of the polygonal main body.

The foundation support system may also include a first pile and a second pile rotationally interlocked to one another through the first and second coupler. One of the first and second piles may include a helical auger. The foundation support system may also include a bracket, a plate, or a lifting assembly for supporting the foundation. The first pile and the second pile may be filled with a cementitious material. Neither of the first or second coupler may include a fastener hole, and the axial interlock may be realized solely by the spring retainer element without any threaded fastener.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A foundation support system ensuring a stability of a building structure with at least a first structural shaft and a second structural shaft transferring and distributing a weight of the building structure to load bearing soil to prevent the foundation from moving or shifting, the foundation support system comprising:

a first coupler attached to the first structural shaft, the first coupler having a first inner circumference and a first outer circumference;

a second coupler attached to the second structural shaft, the second coupler having a second inner circumference and a second outer circumference, wherein the second outer circumference of the second coupler is configured to rotationally interlock with the first inner circumference of the first coupler; and a spring retainer element extending entirely on an exterior circumference of the first coupler, wherein the spring retainer element is configured to automatically engage an exterior circumference of the second coupler and axially interlock the exterior circumference of the first coupler to the exterior circumference of the second coupler with snap-fit engagement;

wherein the axial interlock avoids a separation of the first and second couplers at a below ground location due to axially directed uplift forces after the foundation support system is installed;

wherein each of the first and second couplers includes a plurality of ribs or a plurality of grooves, the plurality of ribs and the plurality of grooves being rotationally interlocked when the first and second couplers are mated;

wherein the plurality of ribs are respectively formed with a retainer groove, and the retainer groove receiving a portion of the spring retainer element with snap-fit engagement when the first and second couplers are mated.

2. The foundation support system of claim 1, wherein the plurality of ribs or the plurality of grooves includes a plurality of helical ribs or a plurality of helical grooves.

3. The foundation support system of claim 2, wherein each helical rib or helical groove completes only about ¼ turn on a surface of the respective first or second coupler.

4. The foundation support system of claim 3, wherein the plurality of ribs includes four helical ribs and wherein the plurality of grooves includes four helical grooves.

5. The foundation support system of claim 1, wherein the spring retainer element is permanently attached to the first outer circumference of the first coupler.

6. The foundation support system of claim 5, wherein the spring retainer element is a planar element fabricated from a resiliently deflectable material.

7. The foundation support system of claim 6, wherein the spring retainer element is an annular element having an expandable inner diameter.

8. The foundation support system of claim 1, wherein one of the first and second structural shafts includes a helical auger.

9. The foundation support system of claim 8, further comprising one of a bracket, a plate, or a lifting assembly for supporting the foundation.

10. The foundation support system of claim 1, wherein the first structural shaft and the second structural shaft are filled with a cementitious material.

11. The foundation support system of claim 1, wherein neither of the first or second coupler includes a fastener hole.

12. The foundation support system of claim 1, wherein the axial interlock is realized solely by the spring retainer element without any threaded fastener.

13. The foundation support system of claim 1, wherein the plurality of ribs or the plurality of grooves includes a plurality of linear ribs or a plurality of linear grooves.

14. The foundation support system of claim 1, wherein the plurality of ribs includes three ribs spaced unevenly from one another.

15. The foundation support system of claim 1, wherein each of the first coupler and the second coupler includes a main body, the plurality of ribs or the plurality of grooves extending on the main body of the first coupler and the second coupler.

16. The foundation support system of claim 15, wherein the main body of one of the first coupler and the second coupler is polygonal.

17. The foundation support system of claim 16, wherein the main body of one of the first coupler and the second coupler is hexagonal.

18. The foundation support system of claim 16, wherein the main body of one of the first coupler and the second coupler is square.

19. The foundation support system of claim 15, wherein the main body of the first coupler is axially tapered.

20. The foundation support system of claim 15, wherein the main body of the first coupler and the second coupler are each round.

21. The foundation support system of claim 15, wherein at least one of the plurality of ribs and one of the plurality of grooves is axially tapered.

22. The foundation support system of claim 15, wherein the main body of one of the first coupler and the second coupler is non-round and wherein the main body of the other of the first coupler and the second coupler is round.

23. The foundation support system of claim 15, wherein one of the first coupler and the second coupler includes a polygonal main body having a number of sides, and wherein the plurality of ribs are located at an intersection of each of the number of sides.

24. A foundation support system ensuring a stability of a building structure with at least a first structural shaft and a second structural shaft transferring and distributing a weight of the building structure to load bearing soil to prevent the foundation from moving or shifting, the foundation support system comprising:

a first coupler attached to the first structural shaft, the first coupler having a first inner circumference and a first outer circumference;

a second coupler attached to the second structural shaft, the second coupler having a second inner circumference and a second outer circumference, wherein the second outer circumference of the second coupler is configured to rotationally interlock with the first inner circumference of the first coupler; and a spring retainer element extending entirely on an exterior circumference of the first coupler, wherein the spring retainer element is configured to automatically engage an exterior circumference of the second coupler and axially interlock the exterior circumference of the first coupler to the exterior circumference of the second coupler with snap-fit engagement;

wherein the axial interlock avoids a separation of the first and second couplers at a below ground location due to axially directed uplift forces after the foundation support system is installed;

wherein each of the first and second couplers includes a plurality of ribs or a plurality of grooves, the plurality of ribs and the plurality of grooves being rotationally interlocked when the first and second couplers are mated; and wherein each of the plurality of ribs includes a first portion having a first outer diameter passing through an initial inner diameter of the spring retainer element when the first and second couplers are partly mated.

25. The foundation support system of claim 24, wherein each of the plurality of ribs further is formed with a ramp at an end of the first portion, and wherein the ramp in each rib contacts the inner diameter of the spring retainer element and expands the initial inner diameter of the spring retainer element to a larger diameter when the first and second couplers are further mated.

26. The foundation support system of claim 25, wherein each of the plurality of ribs further is formed with a second portion having a second outer diameter greater than the first outer diameter, the second outer diameter passing through the larger inner diameter of the spring retainer element when the first and second couplers are further mated.

27. The foundation support system of claim 26, wherein each of the plurality of ribs further is formed with a retainer groove in the second portion, and wherein the spring retainer element resiliently returns back to the initial diameter in the respective retainer grooves of the plurality of ribs when the first and second couplers are fully mated.

* * * * *